US009951990B2

(12) United States Patent
Corver

(10) Patent No.: US 9,951,990 B2
(45) Date of Patent: Apr. 24, 2018

(54) METHOD AND SYSTEM FOR FREEZE-DRYING INJECTABLE COMPOSITIONS, IN PARTICULAR PHARMACEUTICAL COMPOSITIONS

(75) Inventor: Jozef Antonius Willem Maria Corver, Nuenen (NL)

(73) Assignee: RHEAVITA B.V., Eindhoven (NL)

( * ) Notice: Subject to any disclaimer, the term of this patent is extended or adjusted under 35 U.S.C. 154(b) by 987 days.

(21) Appl. No.: 14/343,060

(22) PCT Filed: Aug. 27, 2012

(86) PCT No.: PCT/NL2012/050585

§ 371 (c)(1),
(2), (4) Date: Mar. 6, 2014

(87) PCT Pub. No.: WO2013/036107

PCT Pub. Date: Mar. 14, 2013

(65) Prior Publication Data

US 2014/0215845 A1 Aug. 7, 2014

(30) Foreign Application Priority Data

Sep. 6, 2011 (NL) ..... 1039026

(51) Int. Cl.
*F26B 5/06* (2006.01)

(52) U.S. Cl.
CPC ..... *F26B 5/06* (2013.01)

(58) Field of Classification Search
CPC .. F26B 5/06; F26B 5/04; G01N 21/35; G01N 21/3581; G01N 21/359; G01N 21/3554
(Continued)

(56) References Cited

U.S. PATENT DOCUMENTS 3,199,217 A * 8/1965 Oldenkamp ..... A23L 3/44 34/144
3,292,342 A 12/1966 Martin
(Continued)

FOREIGN PATENT DOCUMENTS

GB 861 082 2/1961
WO WO 96/29556 9/1996

OTHER PUBLICATIONS

International Search Report for PCT/EP2012/050585, dated Nov. 13, 2012.

(Continued)

*Primary Examiner* — Kenneth Rinehart
*Assistant Examiner* — Bao D Nguyen
(74) *Attorney, Agent, or Firm* — Nixon & Vanderhye P.C.

(57) ABSTRACT

The invention relates to a method for freeze-drying injectable compositions, in particular pharmaceutical compositions, comprising: A) storing a quantity of a dispersion of an injectable composition in an aqueous dispersion medium in at least one ready-to-use vial, B) rotating the vial at least for a period of time to form a dispersion layer at an inner surface of a circumferential wall of the vial, C) during rotating of the vial according to step B) cooling the vial to form ice crystals at the inner surface of the circumferential wall of the vial, and D) drying the cooled composition to sublime at least a portion of the ice crystals formed in the dispersion by substantially homogeneously heating the circumferential wall of the vial. The invention also relates to a freeze-dried composition obtained by the method according to the invention and a system for freeze-drying injectable compositions, in particular pharmaceutical compositions, in particular by making use of the method according to the invention.

11 Claims, 22 Drawing Sheets

(58) Field of Classification Search
USPC ..... 34/284, 92, 287, 288; 356/73.1, 356/426–428, 432–436, 440–442, 237.1, 356/237.2, 302, 303, 311, 317, 318, 319, 356/320, 337, 338, 364, 369, 402, 407, 356/409; 374/16, 27, 28, 45, 121
See application file for complete search history.

(56) References Cited

U.S. PATENT DOCUMENTS 3,571,940 A * 3/1971 Bender ..... F26B 5/06 220/592.01
5,760,711 A * 6/1998 Burns ..... B64D 15/20 340/583
5,964,043 A * 10/1999 Oughton ..... F26B 5/06 34/284
6,122,836 A 9/2000 Tenedini et al.
2003/0154623 A1 8/2003 Htoo et al.
2008/0271469 A1* 11/2008 Coffey ..... F25C 5/002 62/132
2011/0247234 A1* 10/2011 Friess ..... F26B 5/06 34/427

OTHER PUBLICATIONS

International Preliminary Report on Patentability dated Dec. 13, 2013.
Comparison of near-infrared and thermal infrared cloud phase detections, Petr Chylek, et.al; J.Geophysical Res., Oct. 21, 2006, vol. 111 D20.
Three-Dimensional Visualization of Ice Crystals in Frozen Materials by Near-Infrared Imaging Spectroscopy; Gabsoo Do, et.al.; Trans. Jap. Soc. Refrigeration and Air Conditioning Engineers, vol. 22 (2005) No. 2, pp. 185-191.
In-Line and Real-Time Process Monitoring of a Freeze Drying Process Using Raman and NIR Spectroscopy as Complementary Process Analytical Technology (PAT) Tools; T. DeBeer, et.al.; Journal of Pharmaceutical Sciences, vol. 98, No. 9, Sep. 2009, pp. 3430-3446.

* cited by examiner

METHOD AND SYSTEM FOR FREEZE-DRYING INJECTABLE COMPOSITIONS, IN PARTICULAR PHARMACEUTICAL COMPOSITIONS

This application is the U.S. national phase of International Application No. PCT/NL2012/050585 filed 27 Aug. 2012 which designated the U.S. and claims priority to NL Patent Application No. 1039026 filed 6 Sep. 2011, the entire contents of each of which are hereby incorporated by reference.

The invention relates to a method for freeze-drying injectable compositions, in particular pharmaceutical compositions. The invention also relates to a freeze-dried composition obtained by the method according to the invention. The invention further relates to a system for freeze-drying injectable compositions, in particular pharmaceutical compositions, in particular by making use of the method according to the invention.

The technique known as lyophilization or freeze-drying is often employed for injectable pharmaceuticals, which exhibit poor stability in aqueous solutions. Lyophilization processing is suitable for injectables because it can be conducted in sterile conditions, which is primary requirement for parenteral dosage forms. Also, freeze dried products will exhibit the required pharmaceutical properties after reconstitution with solvent. During the lyophilization or freeze drying process water is removed from a composition after it is frozen and placed under a vacuum, allowing the ice to change directly from a solid to a vapour state, without passing through a liquid state. The process consists of three separate, unique, and interdependent processes: a freezing phase, a primary drying phase (sublimation), and a secondary drying phase (desorption).

A conventional method to execute this lyophilisation process is to place a batch of bulk containers, each bulk container provided with a bulk dispersion of composition in water, on hollow shelves inside a sealed chamber. With a thermal fluid flowing through the hollow shelves, the shelves are chilled which in turn reduces the temperature of the containers and the composition inside. At the end of this freezing cycle the aqueous composition is frozen as a plug at the bottom of the container, after which the pressure in the chamber is reduced and the shelves are simultaneously heated to force sublimation of ice crystals formed in the frozen composition. During the sublimation process water vapour will be generated which leaves the surface of the plug in the bottom of the container. The ice-vapour interface, also called the sublimation front, moves slowly downward as the sublimation process progresses. Once a substantial part of the ice crystals has been removed a porous structure of the composition remains. Commonly a secondary drying step will follow to complete the lyophilization cycle wherein residual moisture is removed from the formulation interstitial matrix by desorption with elevated temperatures and/or reduced pressures.

Beside various advantages of freeze-drying including enhanced stability and storage life of a dry composition powder, and rapid and easy dissolution of reconstituted composition, the known method also suffers from serious drawbacks. A main drawback of the known method is that it is a relatively slow process. The whole lyophilisation cycle may last 20-60 hours depending on the product and dimensions of the containers. Therefore the current industrial freeze dryers apply a process with a large number of bulk containers that are processed in a batch, wherein in-batch variations occur due to local variation in the process conditions which cannot be compensated for during the batch process. In the current freeze dryers it is also not possible to optimize the freezing cycle in a controlled manner which renders a constant batch quality even more difficult. When the process is suffering technical problems also the business risk associated with this is large due to the impact on the entire batch. After freeze-drying of the composition in the known bulk process, the composition needs to be dosed and packaged in single-dose vials which process is relatively laborious. This dosing and packaging process is moreover quite delicate since it often occurs that during this process the freeze-dried composition is contaminated by (metal) particles coming from dosing equipment and/or further environmental particles.

An object of the invention is to provide an improved method and system for freeze-drying injectable compositions.

This object can be achieved by providing a method for freeze-drying injectable compositions, in particular pharmaceutical compositions, comprising: A) storing a quantity of a dispersion of an injectable composition in an aqueous dispersion medium in at least one ready-to-use vial, B) rotating the vial at least for a period of time to form a dispersion layer at an inner surface of a circumferential wall of the vial, C) during rotating of the vial according to step B) cooling the vial to solidify and in particular to form ice crystals at the inner surface of the circumferential wall of the vial, and D) drying the cooled composition to sublime at least a portion of the ice crystals formed in the dispersion by substantially homogeneously heating the circumferential wall of the vial. By packaging pre-dosed quantities of composition in ready-to-use vials, dosing and packaging afterwards is no longer necessary which leads to a considerable reduction in process time. Freeze-drying of pre-dosed compositions contained in ready-to-use vials is also beneficiary from a hygienic point of view, since in this manner the risk of contamination of the compositions can be reduced to a minimum. A further efficiency improvement is related to the process of freeze-drying as such. Since the at least one ready-to-use vial is rotated, preferably axially rotated a relatively thin dispersion layer is formed at an inner surface of a circumferential wall of the vial, thereby increasing the surface area to volume ratio of the dispersion. Preferably, a bottom part of the vial is substantially free of dispersion during (axial) rotation of the vial. Hence, the complete dispersion is preferably stretched out as a relatively thin film over the inner surface of the circumferential wall of the vial. Preferably, the vial used is substantially cylindrically shaped and/or comprises a substantially cylindrically shaped circumferential wall. By axially rotating a substantially cylindrical vial a dispersion layer will be formed onto the inner surface of the circumferential wall with a relatively homogeneous (uniform) thickness. A typical thickness of such a thin dispersion layer is about 1 mm. A dispersion layer with a relatively homogeneous thickness facilitates the relatively fast and substantially homogeneous freezing and the subsequent heating of the dispersion which is in favour of the quality of the freeze-dried composition. During the heating process (step D) the circumferential wall of the vial is substantially homogeneously heated. This heating process can be either directly, via supplying thermal energy to the vial, or indirectly, via supplying another kind of energy which is subsequently converted into thermal energy (heat) by the vial and/or the dispersion. As a result of this homogeneous heating of the circumferential wall of the vial the dispersion layer formed on the inner surface of the circumferential wall of the vial is substantially homogeneously heated resulting in a relatively fast and controlled sublimation process during step D). During sublimation the temperature of the frozen dispersion does not increase. Relatively homogeneously heating the circumferential wall can be realized, for example, by using heat conducting means or heat reflecting means substantially homogeneously distributing heat generated by at least one heat source to the circumferential wall of the vial. Hence, freeze-drying a composition by using the method according to the invention is significantly faster (about 15-40 times) and therefore significantly more efficient than conventional freeze-drying processes. In the context of this patent document, the dispersion medium, in particular a solvent, commonly comprises water. The dispersion medium may be enriched with further liquid dispersion media, such as alcohol, in particular methanol and/or ethanol.

To apply the freeze-dried composition, firstly a solvent, commonly water, has to be inserted into the vial after which the composition will dissolve completely (reconstitution) forming a dispersion, in particularly a solution, again. This dispersion is ready to be injected, eventually by way of infusion (parenteral), into a person's or animal's body. Typically, pharmaceutical compositions and biological compositions are suitable to be freeze-dried by using the method according to the invention. More specific examples of suitable compositions are: vaccines and antibodies; penicillin; blood plasma; proteins; enzymes; hormones; viruses and bacteria; and nutrients. After performing the method according to the invention, a ready-to-use quantity of the composition is contained in a, preferably closed (sealed), ready-to-use vial, commonly formed by a small bottle or ampoule. Upon use, an injection needle of a syringe will commonly be pierced through a closing element of the vial after which water is injected to solve the freeze-dried composition. After having dissolved the composition in water within the vial, the aqueous solution comprising the composition is removed from the vial via the injection needle after which the syringe is used to administer the solution to a human or animal. Alternatively, the vial can be configured to be connected to an injection needle, wherein the vial as such may form a part of a syringe, as a result of which the composition does not need to be transferred into another vial which lead to an improved efficiency. According to this embodiment, the vial forms a cylindrical tube, also called a barrel, of the syringe, which is configured to cooperate with a plunger. The ready-to-use vial is commonly a single-dose vial comprising a single-dose quantity of freeze-dried composition. However, it is also conceivable that the ready-to-use vial is a multi-dose vial comprising a limited number, such as two, three, four, or five of single-dose quantities of freeze-dried composition to be administered to a (single) patient. Hence, the term ready-to-use vial in this context means that the contents of the vial can be applied directly after reconstitution with solvent in medical, biological or veterinary practice without the need of prior redistribution of the freeze-dried composition in multiple other vials or containers.

During sublimation step D) preferably an underpressure, in particular vacuum, is generated in the vial. Since the ready-to-use vial is commonly provided with an open top end, applying an underpressure in the vial is commonly realized by positioning the vial in a vacuum chamber. Reducing the pressure towards vacuum in the vial leads to a pressure below the triple point of water. At pressures below the triple point, and when thermal energy is supplied, solid ice is converted directly into water vapour, which sublimation process occurs during step D). A typical underpressure applied to the vial is situated between 0 and 500 mTorr. This underpressure is commonly realized by using a vacuum pump. Water vapour escaping from the frozen dispersion is preferably removed from the vial by using at least one separate (cryogenic) ice condenser which makes the water vapour (re)sublime to ice crystals and/or condense to liquid water which precipitate on and/or in the ice condenser. A typical ice condenser comprises a helical structure cooled to a temperature well below the temperature of the ice at the sublimation front. The resulting partial vapour pressure in the neighbourhood of the ice condenser is therefore lower than the partial vapour pressure near the sublimation front and this facilitates the flow of vapour flow in the direction towards the condenser. It is noted that underpressure is preferably applied after freezing of the dispersion during step C) to prevent boiling of the dispersion.

In addition to the free ice that is sublimed during the drying or sublimation step D), there commonly remains a substantial amount of water molecules that are (ionically) bound (adsorbed) to the composition. At the end of the sublimation step D), the composition will typically have 5 to 15% moisture content. This remaining water fraction is preferably removed by a secondary drying step E), also referred to as desorption step. Since all of the free ice has been removed in primary drying, the composition temperature can now be increased considerably without fear of melting or collapse. Secondary drying actually starts during the primary phase (sublimation), but at elevated temperatures (typically in the 30° C. to 50° C. range in order to preserve the protein structure), desorption proceeds much more quickly. Secondary drying rates are dependant on the composition temperature. System vacuum may be continued at the same level used during primary drying; lower vacuum levels will not improve secondary drying times. Amorphous compositions may require that the temperature increase from primary to secondary drying be controlled at a slow ramp rate to avoid collapse. Secondary drying is continued until the composition has acceptable moisture content for long term storage. Depending on the application, moisture content in fully dried compositions is typically between 0.5% and 3%. In most cases, the more dry the composition, the longer its shelf life will be. However, certain complex biological compositions may actually become too dry for optimum storage results and the secondary drying process (the desorption step) should be controlled accordingly.

After completion of the drying process the vial is preferably closed by using a closing element during step F). Preferably, at least a part of the closing element is configured to be pierced by an injection needle of a syringe. To this end, the closing element commonly comprises a rubber stop which is penetratable (pierceable) by a hollow injection needle of a syringe. In order to secure the rubber stop with respect to the vial it is commonly favourable in case the closing element further comprises a, commonly ring shaped, closing cap.

During step B), overlapping with step C), the vial is preferably axially rotated. As already mentioned such an axial rotation results in the formation of a relatively thin dispersion layer on the inner surface of the circumferential wall of the vial due to centrifugal forces. Preferably, the vial is axially rotated with a typical rotation speed of between 2500 and 3000 revolutions per minute. In a preferred embodiment, the rotation axis and the vial are tilted during step B). The mutual orientation of the rotation axis and the vial is preferably kept identical. More preferably, the rotation axis is tilted from a i) substantially vertical orientation to a ii) substantially horizontal orientation during step B).

This allows the dispersion layer to be formed while preventing the dispersion to remove from the (open) vial (sub step i)), after which the vial and rotation axis are tilted to a substantially horizontal orientation which facilitates formation of the dispersion layer having a substantially homogeneous layer thickness. After tilting the spinning vial, the temperature of the via is reduced to below 0° C., typically to a temperature of between −60° C. and −40° C. resulting in freezing of the dispersion (step C), or at least the aqueous dispersion medium. The temperature profile during this cooling action can be dependent on the composition to be cooled, and may vary from linear cooling down to more complex temperature profiles. Typically this cooling action is continued for about 10 to 20 minutes. Cooling of the dispersion during step C) is preferably realized by using at least one inert cooling gas, such as nitrogen, which cooling gas may surround the at least one vial and/or may be flow, eventually via injection, into said vial to cool down the dispersion. During freezing (step C) the temperature of the surrounding medium is reduced such that the composition in the vial becomes immobile or solid. The remainder of the cooling profile may then be accomplished without further spinning of the vial. The process of solidification may be effectuated within 1-2 minutes. Typically the remainder of the cooling action is continued for about 10-20 minutes eventually reaching a typical temperature of between −60° C. and −40° C. The temperature profile during this cooling action can be dependent on the composition to be cooled, and may vary from linear cooling down to more complex temperature profiles. Cooling of the dispersion during step C) is preferably realized by using at least one inert cooling gas, such as nitrogen or carbon dioxide, which cooling gas may surround the at least one vial and/or may be flow, eventually via injection, into said vial to cool down the dispersion.

In a preferred embodiment of the method according to the invention, during step C) the vial is cooled according to a predefined temperature profile. The solidification or freezing step C) is influential for the structure and quality of the freeze-dried composition. Therefore during this freezing step preferably a predefined cooling temperature profile or scheme is used. The temperature profile may be linear profile though will in practice commonly a non-linear, and even more complex, profile, dependent on the dispersion to be cooled. By means of temperature sensors, eventually applied, the temperature of the vial and/or the dispersion may be monitored during cooling based upon which the cooling process may be adjusted real-time in order to follow the predefined temperature profile as much as possible. In a particularly preferred embodiment cooling of the via may be effectuated by surrounding the vial by a cooling gas, in particular an inert gas having a controlled temperature. For example, the temperature and/or flow speed of said cooling gas may be adjusted dependent on the actual temperatures detected and the temperature profile to be applied.

During the subsequent sublimation step D) preferably use is made of at least one heat conducting means and/or at least one heat reflecting means to substantially homogeneously heat the circumferential wall of the vial. In a preferred embodiment the vial is positioned in a heat conducting jacket. This jacket preferably engages to the outer surface of the circumferential wall to secure homogeneous heat distribution along said outer surface. The jacket may be provided with a heat source, such as an electric heating element. It is also conceivable that the jacket merely forms an intermediate component to transfer energy, in particular heat, emitted by at least one distant heat source towards the outer surface of the circumferential wall of the vial. The jacket may be filled with a heat conducting medium, such as for example water or a gel or any other thermal transfer fluid. It is also thinkable that the jacket is filled with air to transfer heat to the vial in a controlled manner. To this end, preferably an inflatable jacket is used. The pressure difference between the vacuum chamber in which the vial is commonly positioned and the internal pressure in the jacket facilitates the inflation. During step D) commonly at least one heat source is used, wherein the at least one heat source is preferably configured to generate electromagnetic radiation, in particular infrared radiation (wavelength 750 nm to 1 mm) and/or microwaves (wavelength 1 mm to 1 meter). The same system components may also be used in case desorption step E) is applied. The drying step D) will be commonly be executed for a period of time situated between 30 minutes and 2 hours which is significantly faster than conventional drying steps. The same period of time applies to step E) (if applied).

It is possible that (also) during step D) and/or step E (if applied) the vial is rotated at least for a period of time to facilitate homogeneously heating of the circumferential wall of the vial. However, in certain embodiments, for example in case a heating jacket is applied, it could be more favourable to keep the vial as well as the jacket stationary.

In a preferred embodiment, formation of ice crystals in the composition during step C) is monitored by means of a sensor, in particular an optical sensor. The sensor preferably comprises a light source configured to emit light in the near infrared range (0.75-1.4 μm), but preferably electromagnetic radiation in the (sub) Terahertz range (300 GHz-10 THz) is applied. Terahertz radiation facilitates the discrimination between different polymorphs of crystalline structures. Using this monitoring instrument which may be applied to each individual vial, the finalization of the freezing step may be determined, thereby optimizing the duration of this step. The optical sensor is preferably positioned in such a manner with respect to the vial that the dispersion shell can be measured. Since the perimeter of the vial could be surrounded by a heating jacket, the optical beam is preferably directed from the (open) top of the vial or from the bottom of the vial. A particular advantage of the method according to the invention is that the relatively thin dispersion layer formed onto an inner surface of the circumferential wall of the vial can be monitored and analysed by using sensors and/or other detection equipment in a relatively accurate and reliable manner, due to its limited layer thickness and therefore the limited required penetration depth which has to be detected and analysed.

During step A) preferably multiple ready-to-use vials are filled with composition to be freeze-dried, which vials are simultaneously and identically treated during subsequent steps. In this manner multiple pre-dosed quantities of compositions may be packaged in multiple ready-to-use vials respectively in a relatively quick manner. To this end, it is often beneficiary to make use of vial trays configured for simultaneously holding multiple vials. The vials may be transported by using one or multiple conveyors through multiple chambers to perform to successive steps of the method according to the invention.

The ready-to-use vial has preferably a limited internal volume which is typically between 2 and 50 ml which is sufficient for packaging a ready-to-use quantity of composition to be injected into a human body or animal body. As already mentioned the circumferential wall of the vial preferably has a substantially cylindrical shape which facilitates formation of a dispersion layer on the inner surface of this wall during (axial) rotation of the vial. Commonly, the vial is at least partially made of a material which is translucent for electromagnetic radiation, in particular infrared, ultraviolet, and/or visible light. An example of a light-transmitting material is (transparent) plastic or glass. In the context of this patent document a ready-to-use vial has to be understood to include any type of container which is configured to contain a ready-to-use quantity of a freeze-dried composition.

The invention also relates to a freeze-dried composition obtained by the method according to the invention. Examples of suitable freeze-dried compositions have been listed above.

The invention further relates to an assembly of a ready-to-use vial and a freeze-dried composition obtained by performing the method according to the invention. The ready-to-use vial is preferably closed (sealed) by using a closing element. The interior space of the vial can be filled with an inert gas, such as nitrogen, eventually in superatmospheric pressure, to preserve the freeze-dried composition. It is also imaginable to apply a vacuum (underpressure) in the vial to preserve the composition.

The invention moreover relates to a system for freeze-drying compositions, in particular pharmaceutical compositions, preferably by making use of the method according to the invention, comprising: at least one rotating element for rotating at least one ready-to-use vial for an injectable composition in an aqueous dispersion medium to form a dispersion layer at an inner surface of a circumferential wall of the vial, at least one cooling module for cooling said vial to form to form ice crystals at the inner wall of the vial, and at least one sublimation module provided with at least one heating source to sublime at least a portion of the ice crystals formed in the dispersion by substantially homogeneously heating the circumferential wall of the vial. Advantages of this particular manner of freeze-drying of injectable compositions have been described above already in a comprehensive manner. Preferably, the cooling module and the sublimation module are mutually separated by separation means. These separation means may comprise an intermediate compartment, in particular a load-lock. Such a load-lock is commonly formed by a revolving door via which the vial is transported from one module to an adjacent module. In a preferred embodiment this load-lock comprises a cylindrical chamber which is divided in four compartments, said chamber being rotatable about a vertical axis. The entering vial is pushed into a first compartment and the chamber rotates to a position that the dividing walls hermetically close the compartment. In this position the vacuum pump establishes the desired condition and when the next position is achieved, the vial is guided into the vacuum chamber by the movement of the rotary chamber which pushes the vial to a guiding means, which is partially intruding into the compartment. In an alternative embodiment only the cylindrical doors are rotating. In this embodiment, the door is formed by a cylinder with an opening through which a vial can pass. When this opening is matching the position of the vial, the vial is pushed into the chamber. The door continues to rotate while the chamber is evacuated. Once the opening is in the desired position a gripper pulls the vial onto the transport mechanism in the vacuum chamber.

In order to exhibit the vial to the different system modules, the system preferably comprises transporting means, in particular an endless conveyor belt, for transporting the at least one vial through the different modules. The endless belt system is preferably provided with pockets to hold individual vials. Transporting of the vials allows the method according to the invention to be executed as a continuous process which is commonly very favourable from an economic and logistic point of view. This endless belt system preferably remains in a closed housing of the system, as a result of which the conveyor belt can be kept under sterile condition.

The at least one rotating element may make part of the transporting means, as a result of which the vial is (automatically) rotated during transport. It could also be favourable to apply a separate rotating element which does not make part of the transporting means.

In a further preferred embodiment, the system further comprises at least one desorption module for driving bound water from the composition. This desorption module is configured to carry out a secondary drying step for reducing the moisture content of the composition to about 0.5%. Both the sublimation module and the desorption module are commonly provided with a heating means to realize the desired sublimation and successive desorption.

After freeze-drying the composition in the ready-to-use vial the vial is preferably closed in at least one closing module by using a closing element. The closing element preferably comprises a rubber stop configured to be positioned at least partially in the vial, and a securing cap to secure the rubber stop with respect to the vial.

Preferably, the system, in particular the sublimation module and/or intermediate compartment, is provided with at least one vacuum pomp for applying an underpressure in the vial. Preferably the vacuum pomp is cooperating with at least one ice condenser for subliming water vapour generated in the vial during sublimation. The ice condenser is positioned at a distance from the vial(s). In the sublimation module preferably heat transferring means (heat conducting means or heat reflecting means) are present to distribute heat generated either directly or indirectly by a heat source towards the circumferential wall of the vial. The heat transferring means may comprise a (inflatable or non-inflatable) heating jacket configured to surround the vial to be heated.

Preferably, all system modules are connectedc in succession. By means of a transporting means the vial(s) can be guided along or through each module. It is thinkable that the system comprises a detection device for detecting the quantity of ice crystals present in the composition. Such a detection device preferably comprises at least one light source, at least one optical sensor, and at least one control unit connected to said optical sensor.

The heating source used in the sublimation module and, if applied, the desorption module may be an electrical heating element. It is also possible that the heating source comprises at least one electromagnetic source configured for generating infrared radiation and/or microwaves.

Further embodiments of the method and the system according to the invention are described in the priority patent application NL 1039026, the content of which is incorporated herein by reference.

The invention will be elucidated on the basis of non-limitative exemplary embodiments shown in the following figures. Herein:

Figure 4:
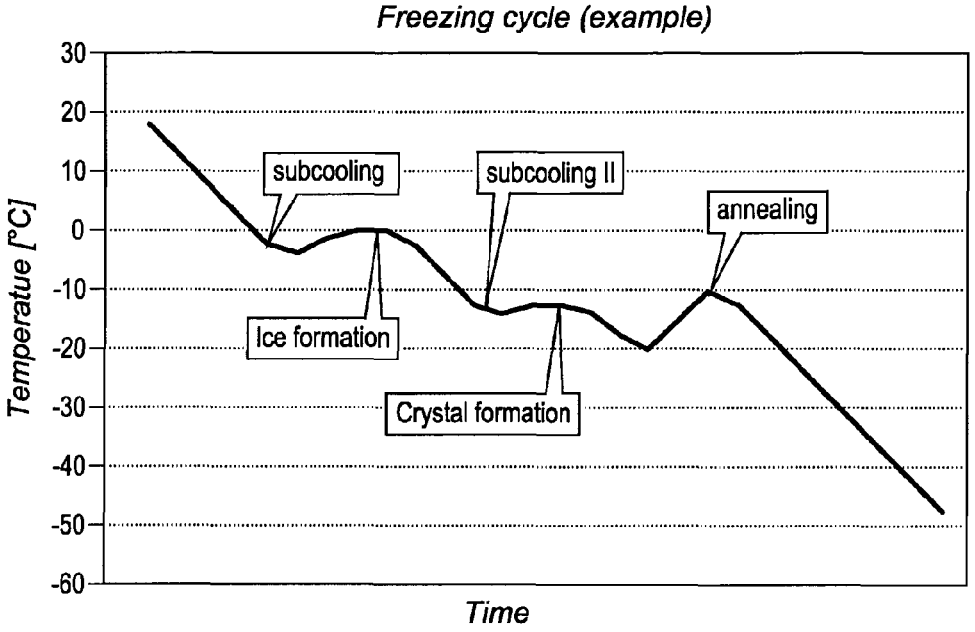
Figure 6:
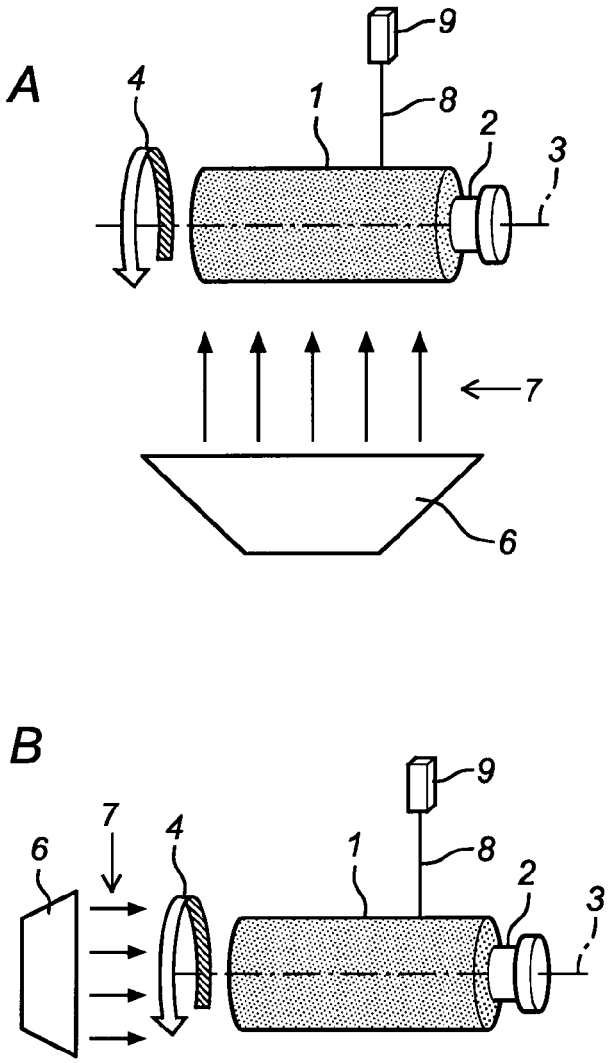
Figure 7:
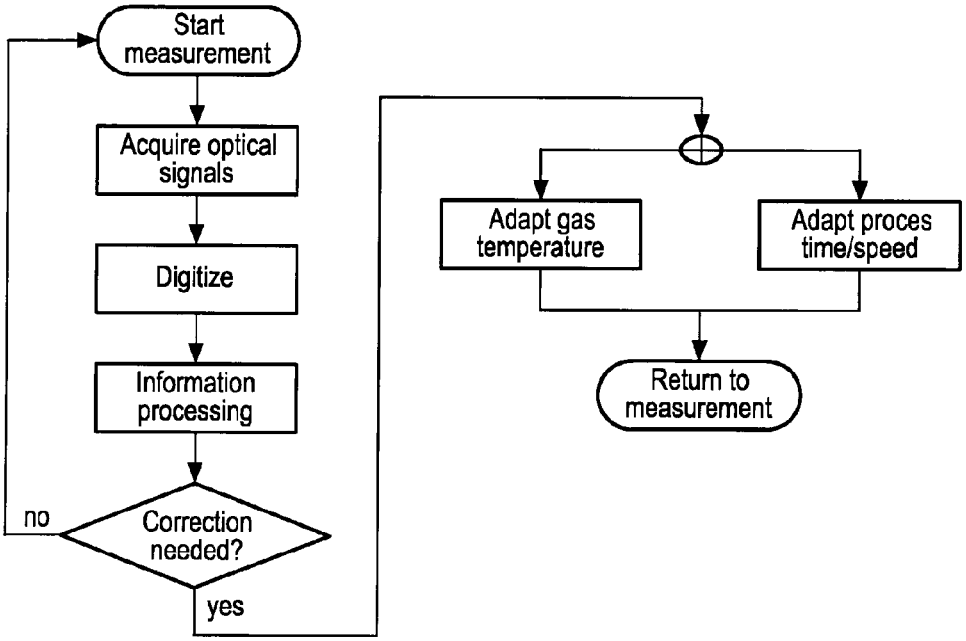

FIGS. 3*a*-3*c* show different conveyor belts for use in a system according to the invention;

FIG. 4 shows a chart of a freezing process;

FIGS. 5*a*-5*b* show successive views of the rotation process of a vial containing a dispersion as part of the method according to the invention;

FIGS. 6*a*-6*b* show two different configurations for freezing and detecting a dispersion contained in a rotated vial;

FIG. 7 shows a flow diagram of monitoring the freezing process of a dispersion contained in a vial, as shown in FIGS. 6*a*-6*b;*

Figure 8:
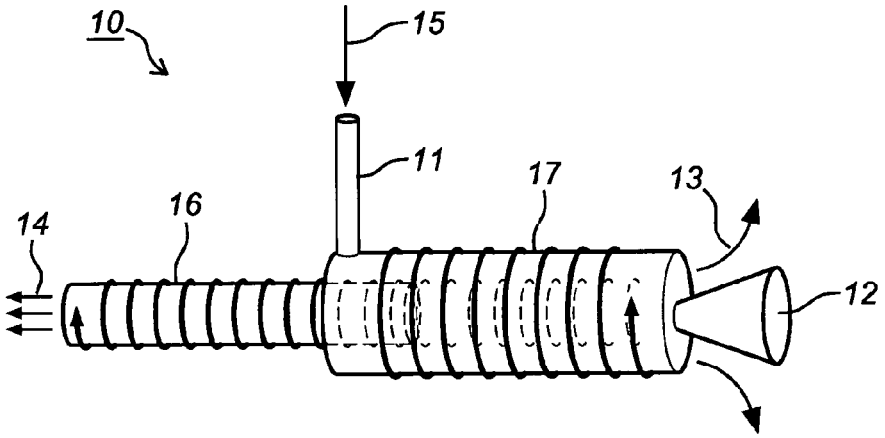

FIG. 8 shows a schematic representation of a Ranque-Hilsch tube for generating cooling gas for cooling the vials shown in FIGS. 6*a*-6*b;*

Figure 9:
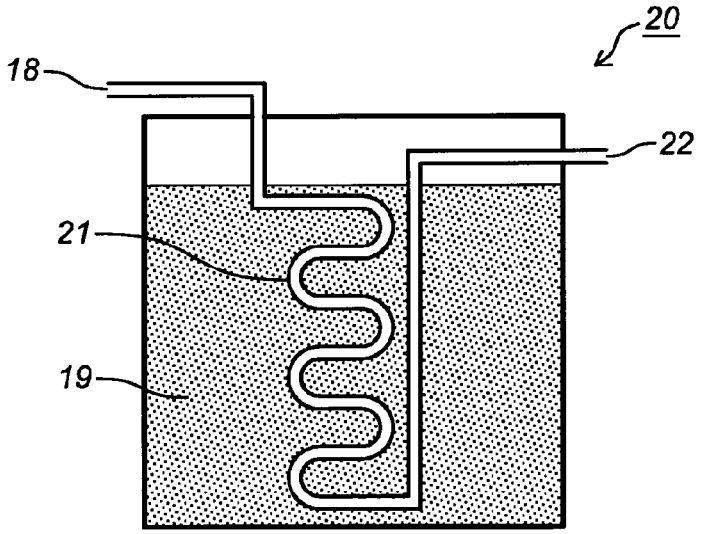
Figure 10:
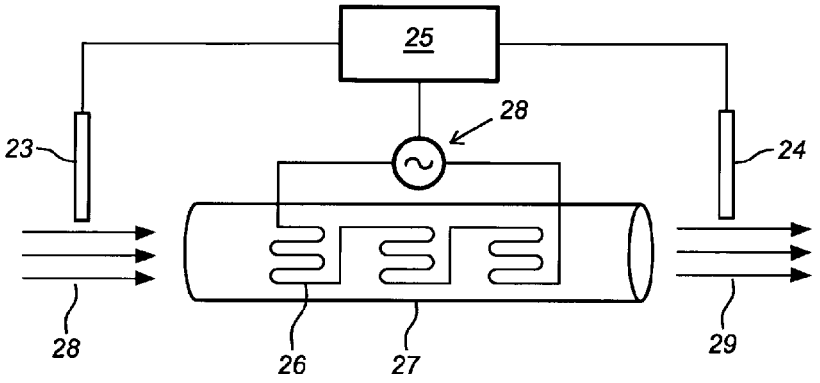
Figure 11:
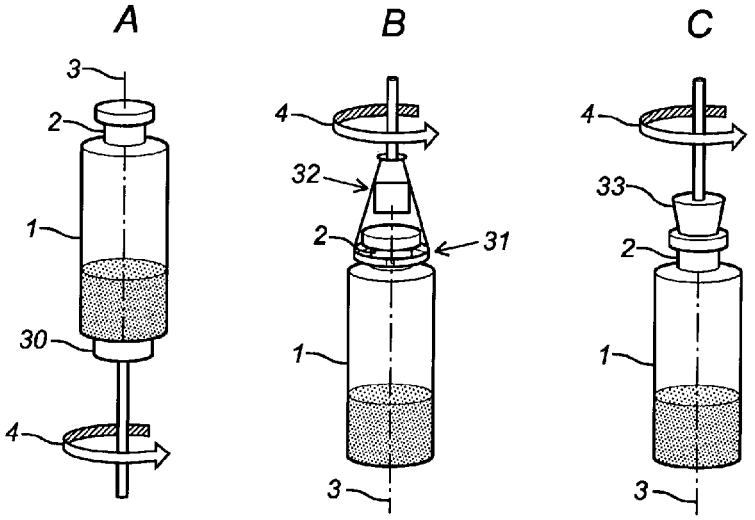
Figure 12:
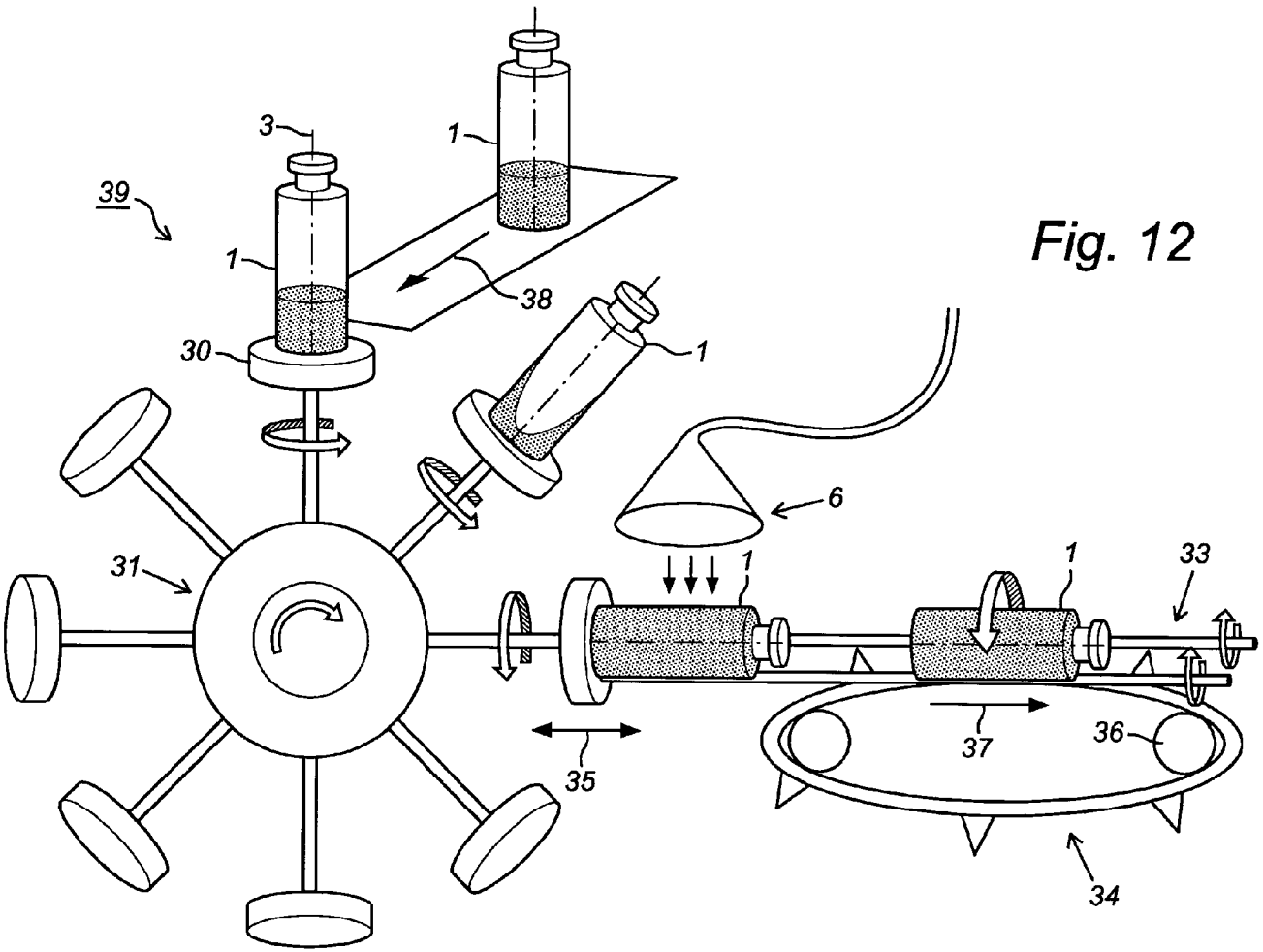
Figure 13:
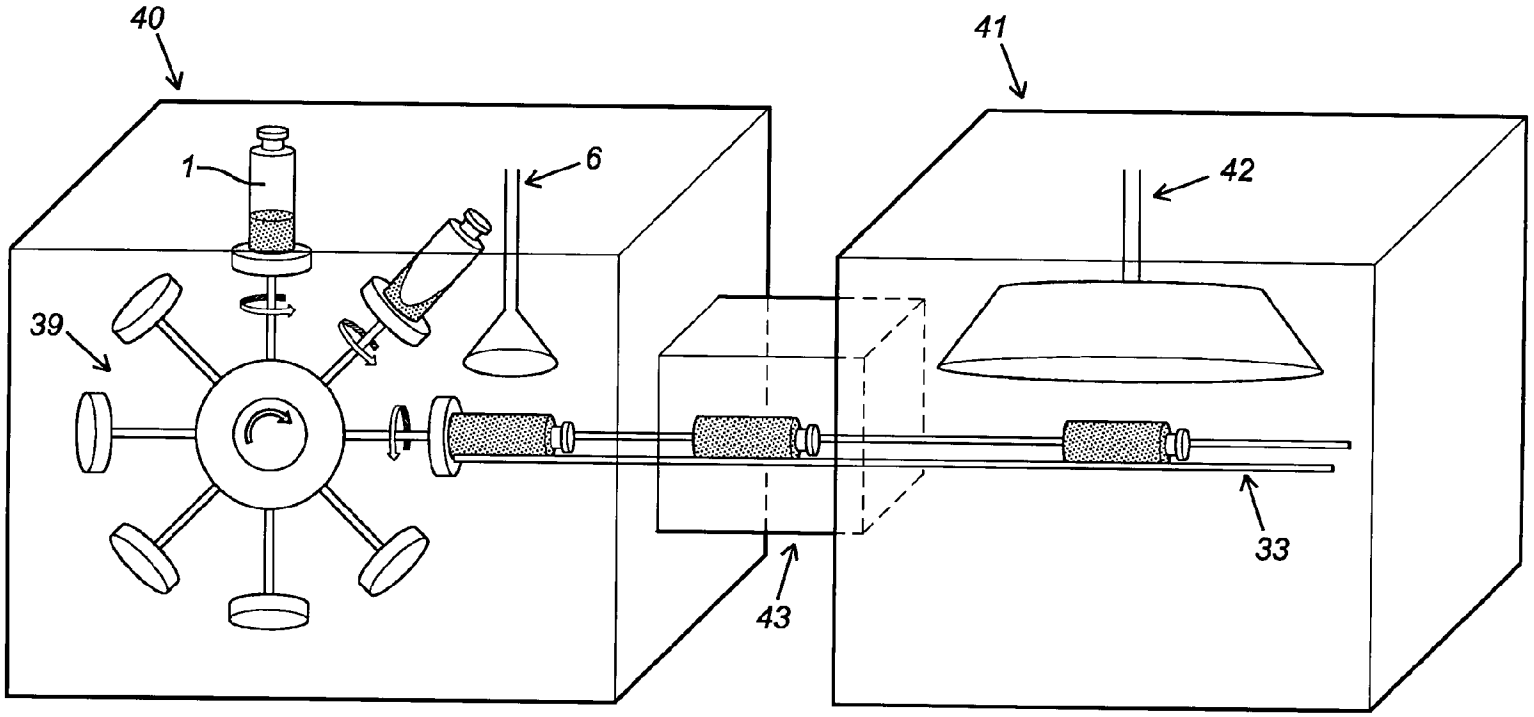
Figure 15:
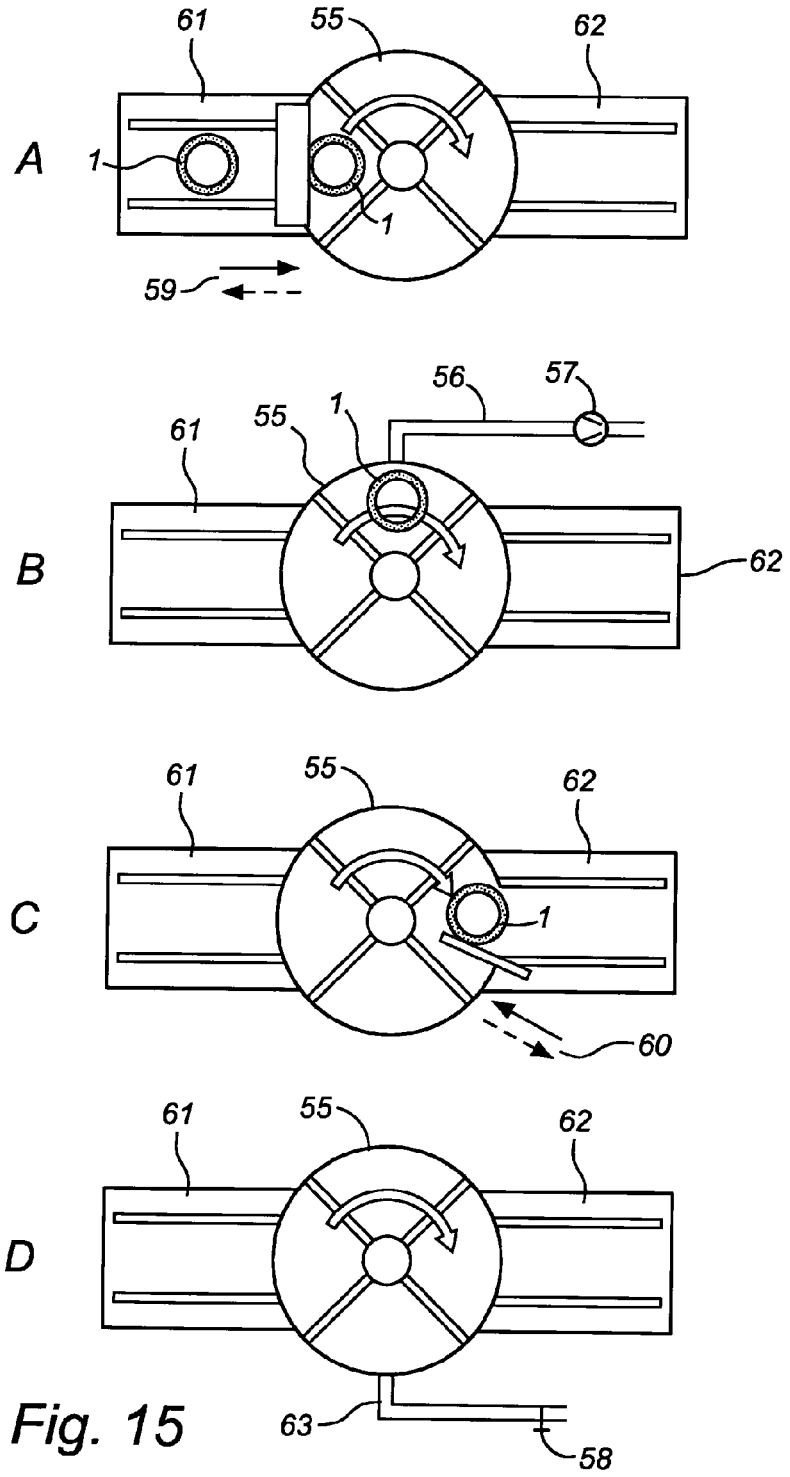
Figure 16:
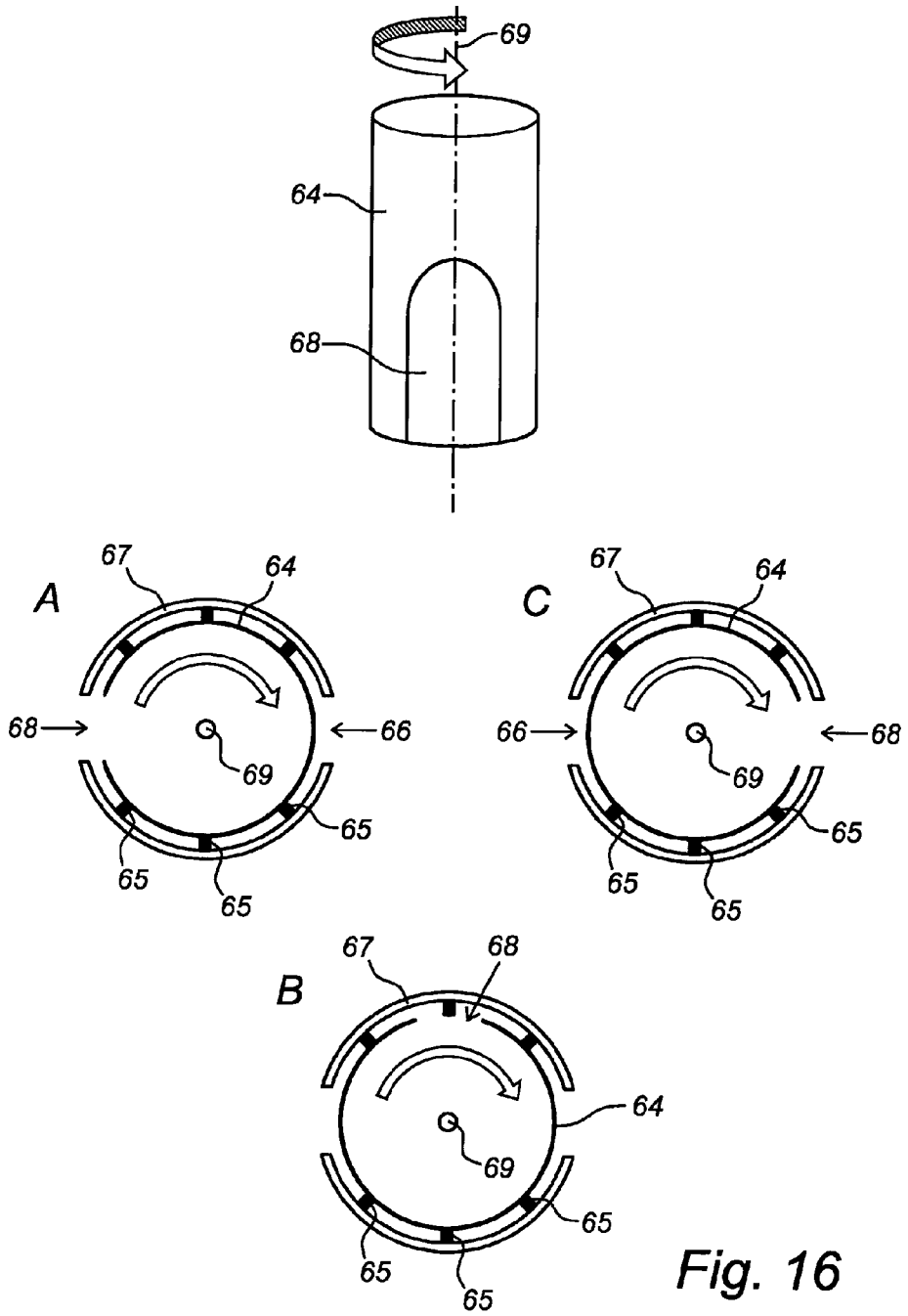
Figure 17:
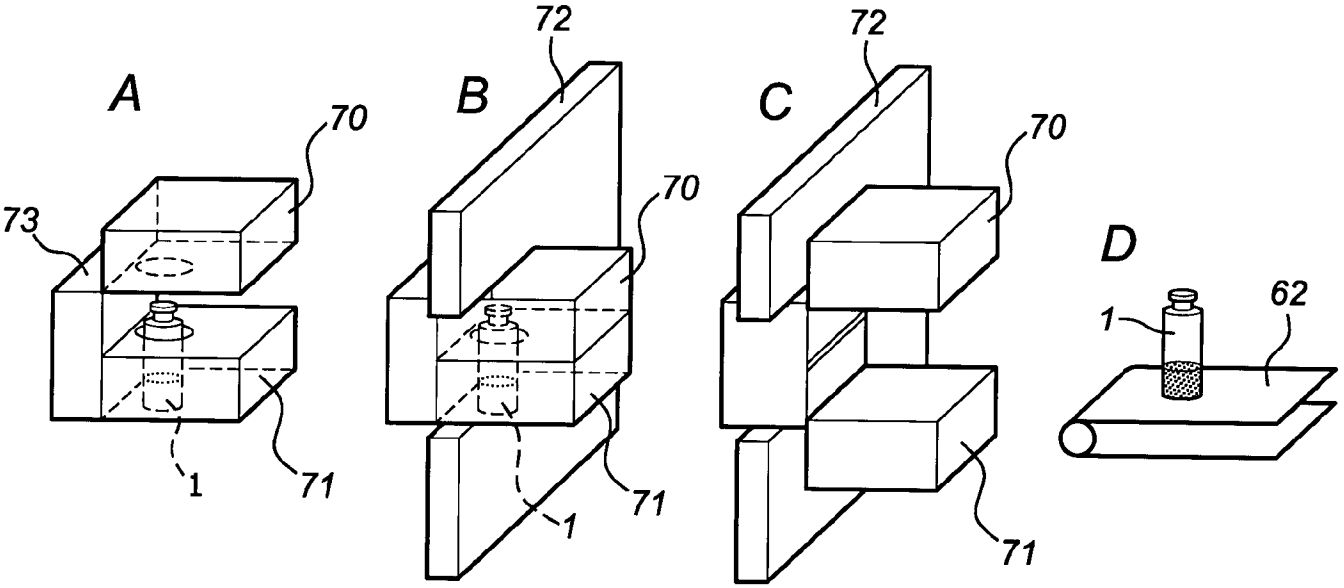
Figure 18:
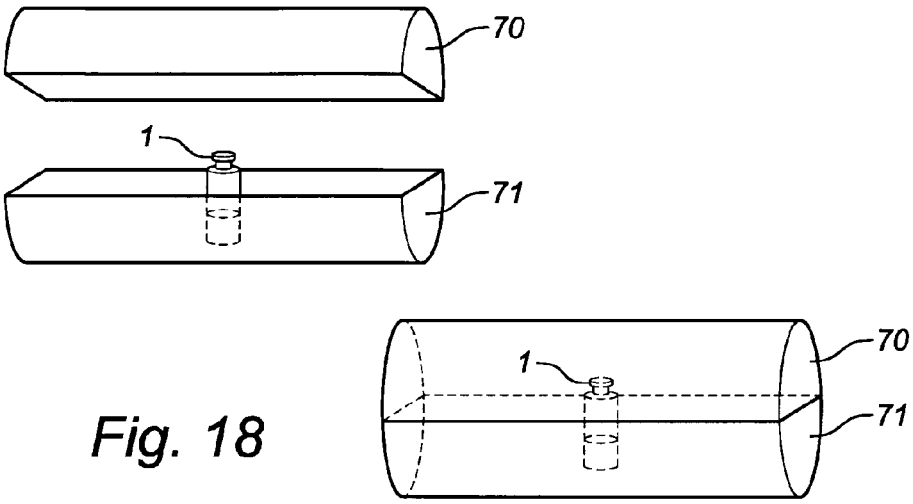
Figure 20:
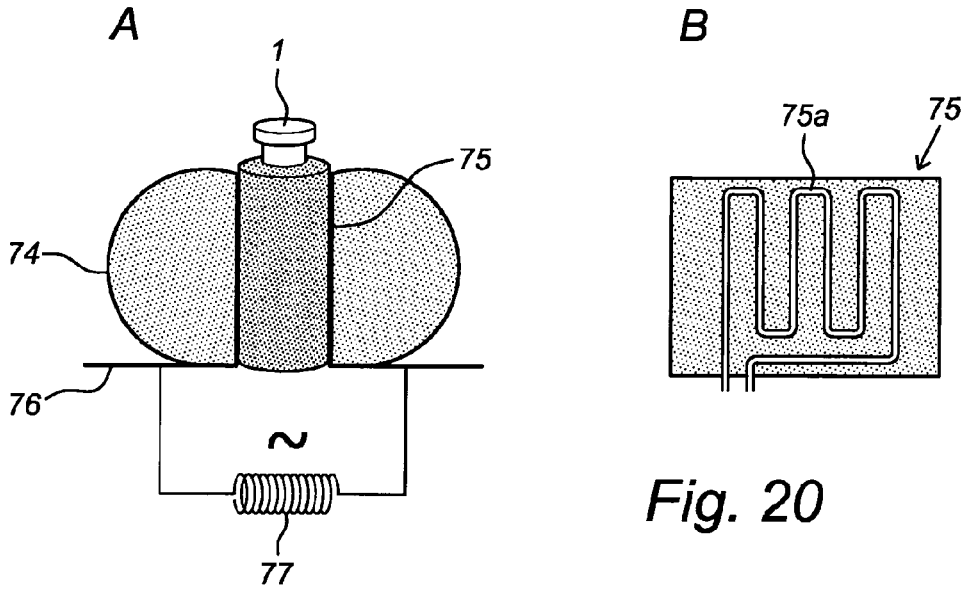
Figure 22:
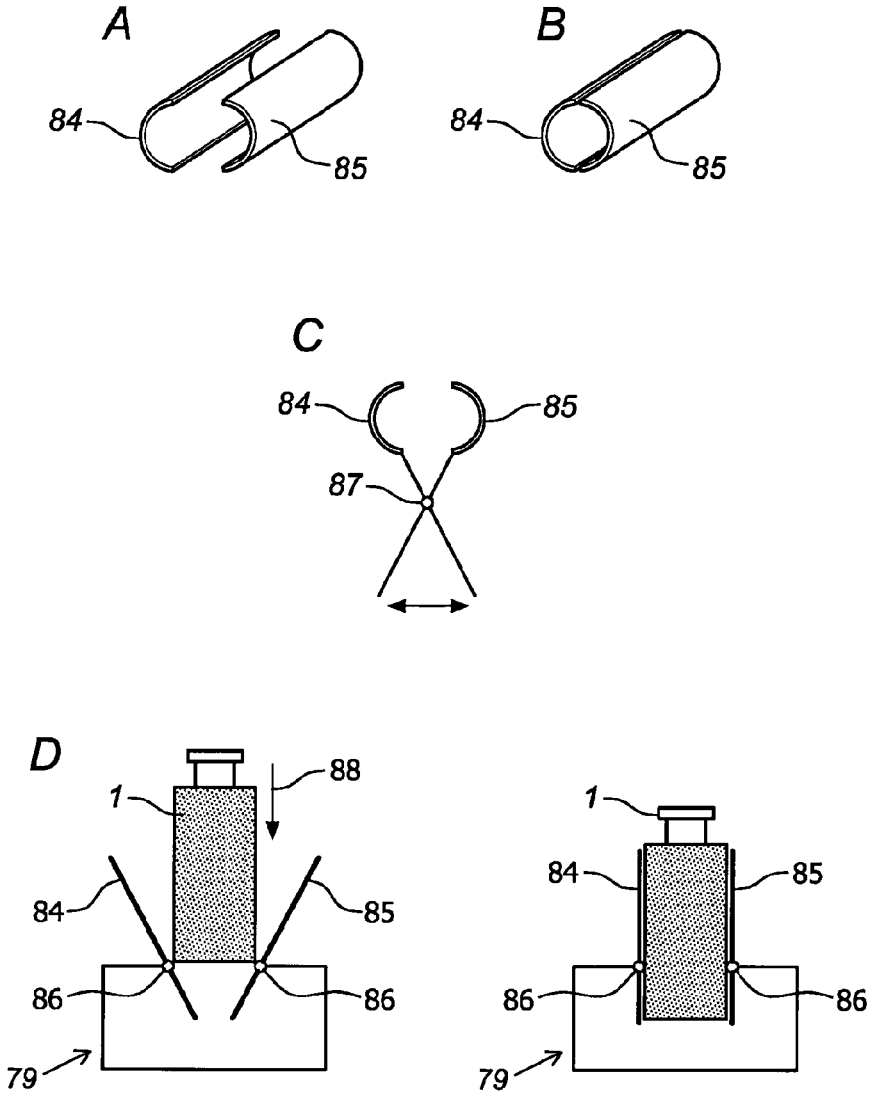
Figure 23:
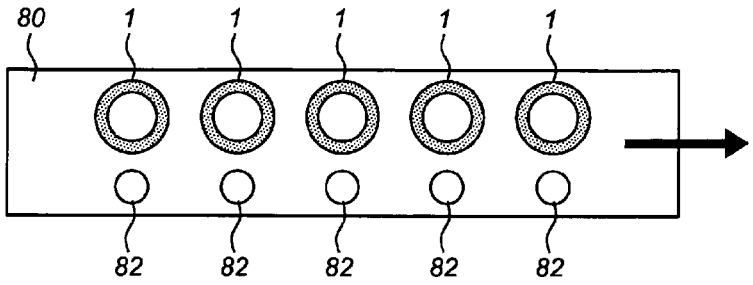
Figure 24:
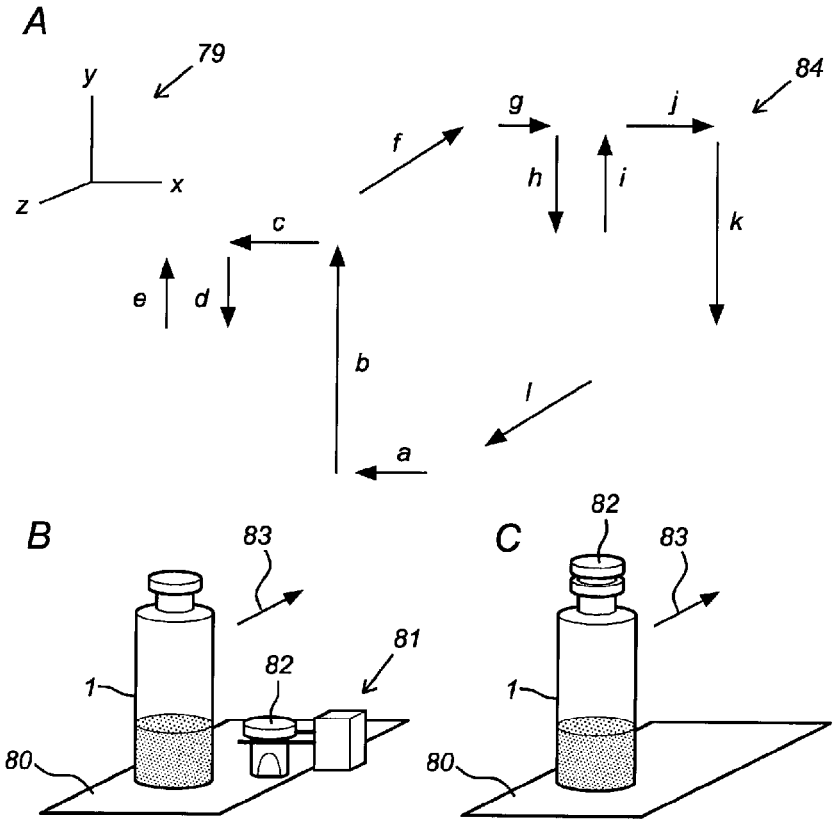
Figure 25:
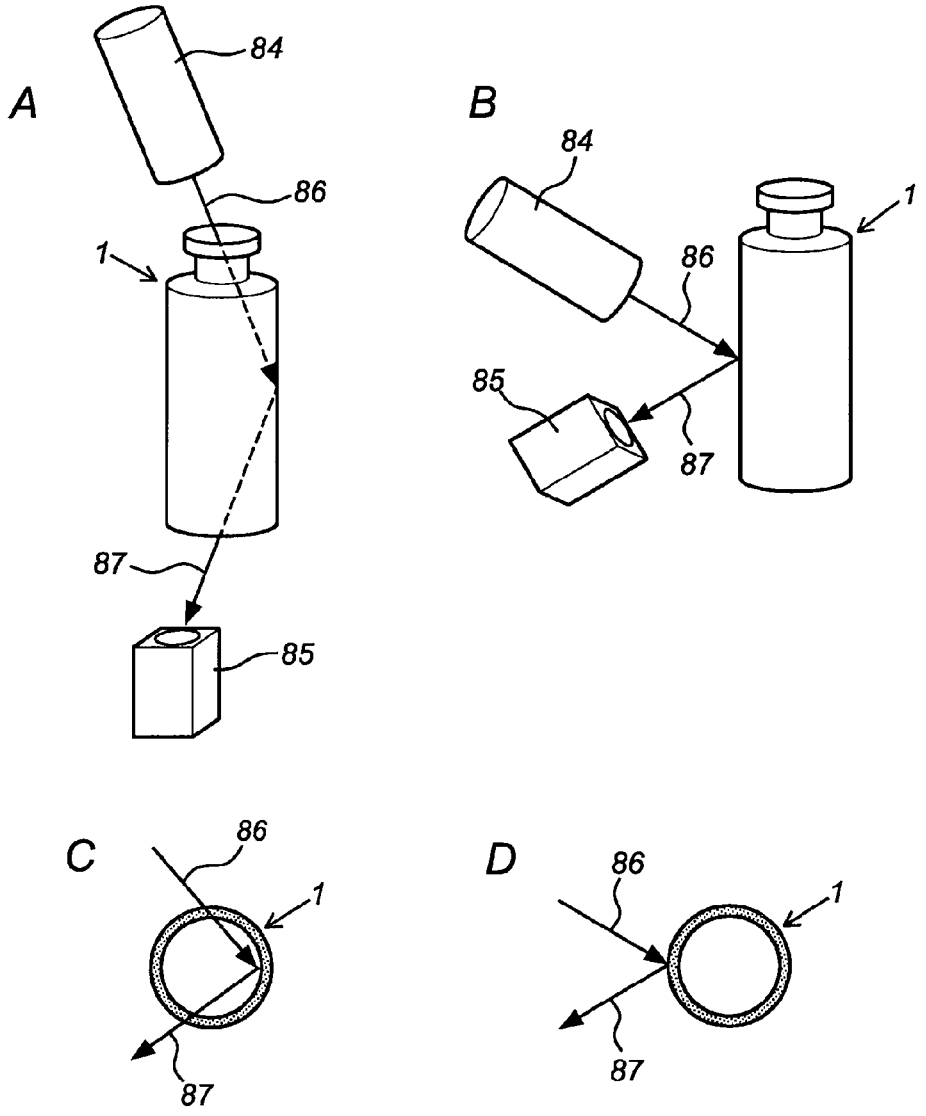
Figure 26:
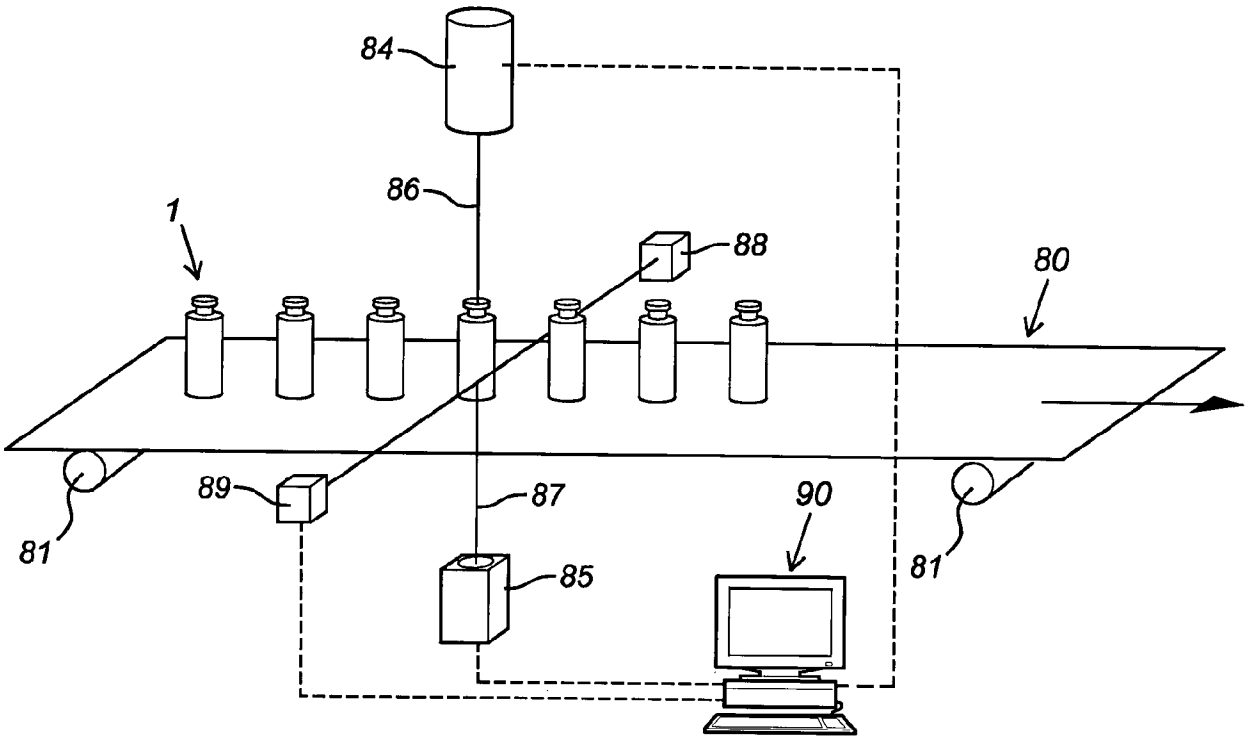
Figure 27:
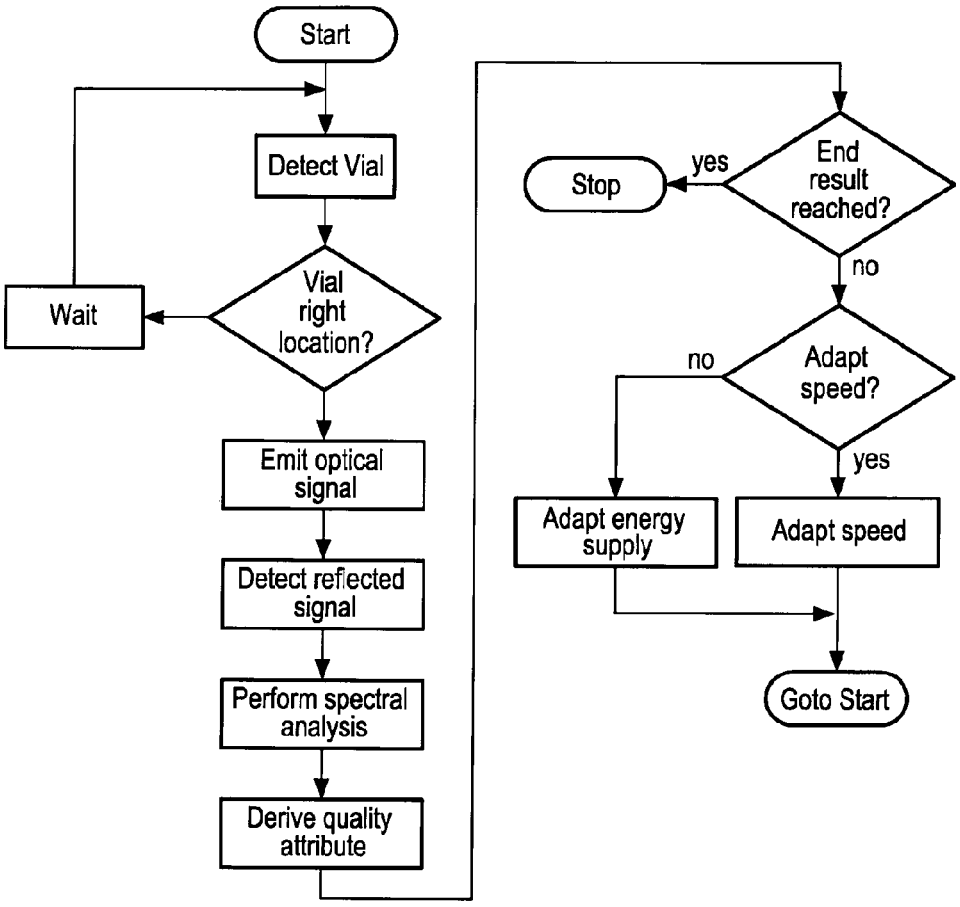

FIG. 9 shows an alternative manner for generating cooling gas using a cryogenic medium;

FIG. 10 shows a schematic representation of the control of the cooling gas temperature;

FIG. 11 shows different fixation mechanisms during rotation of vials for use in a system according to the invention;

FIG. 12 shows a schematic view of a freezing module with rotary freezing for use in a system according to the invention;

FIG. 13 shows a schematic representation of a further freezing module having primary and secondary freezing sub-modules with an intermediate load-lock;

FIGS. 14*a*-14*c* show different transport mechanisms to transport vials in a horizontal orientation;

FIG. 15 shows an open top view a rotation load-lock system for continuous processing of vials for use in a system according to the invention;

FIG. 16 shows an alternative load-lock with quasi-continuous functionality for use in a system according to the invention;

FIG. 17 shows a further embodiment of a load-lock for a system according to the invention;

FIG. 18 shows another load-lock for a system according to the invention;

FIGS. 19*a*-19*d* show different views of radial fixation of a vial using inflatable ring;

FIG. 20 shows a schematic view of an assembly of a vial and an electrical heating jacket for use in a system according to the invention;

FIGS. 21*a*-21*b* show a side view and a top view of a sublimation module for a system according to the invention;

FIG. 22 shows alternative solution to fixate a vial for use in a system according to the invention;

FIG. 23 shows a top view of a conveyor belt configured for combined transportation of containers and closures;

FIG. 24 shows schematically the positioning process for a closure to be secured to a vial by robotic movement;

FIG. 25*a*-25*d* show different detecting devices for use in a system according to the invention;

FIG. 26 shows a detecting system comprising a detecting device as shown in FIG. 25 for use in a system according to the invention; and FIG. 27 shows a flow diagram for control of a drying step of the method according to the invention.

Figure 1:
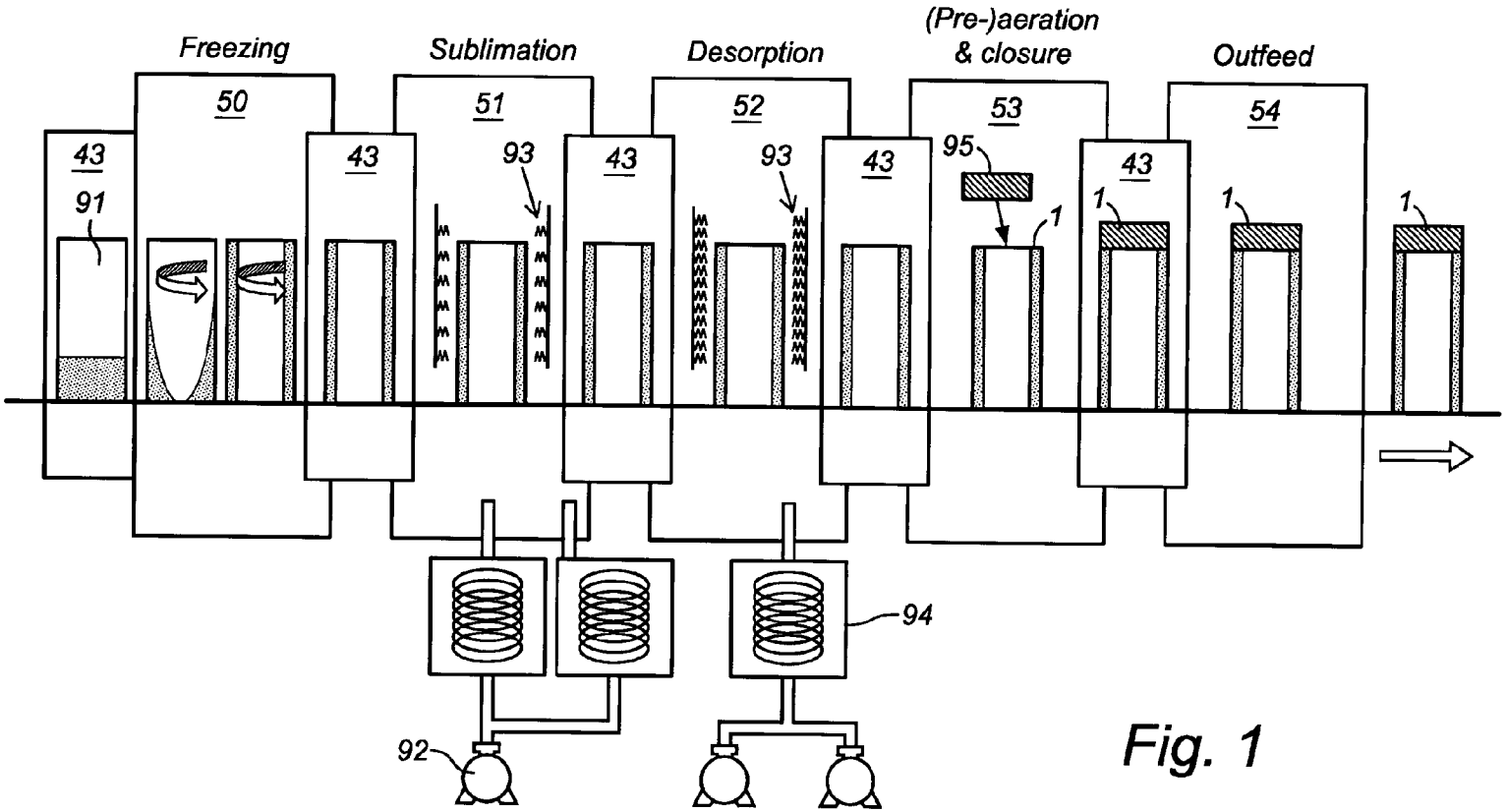
FIG. 1 shows a schematic side view of a continuous freeze drying system according to the invention.

The full system is schematically described with reference to FIG. 1. A continuous row of vials 1 is moving through a connected line of process modules. The system comprises a Freezing Module 50, a Sublimation Module 51, a Desorption Module 52, a Pre-aeration & Closure Module 53 and an Outfeed Module 54. The different modules are interconnected by locks 43 to separate the different conditions. In the freezing module a dispersion of an injectable composition in an aqueous dispersion medium in a ready-to-use vial 91, in particular single-dose vial, is cooled and with specific process settings the various phase transitions (crystallization) and glass transitions are achieved in a controlled manner. In the sublimation module 51 the solvent crystals (in most cases ice) are sublimating by applying by means of a vacuum pump 92 a vacuum below the triple point of water and at the same time supplying energy in the form of thermal heat by using a heating element 93 to compensate the latent heat of sublimation. In the desorption module the solvent which initially was not frozen into crystals, but absorbed or encapsulated, is removed by further supplying thermal heat by using said heating element 94 or another heating element. Since the crystalline solvent already has been removed in the previous step, melting will not occur and therefore temperatures well above the melting temperature can be applied. To collect the vapour from the sublimation and desorption module a condenser 93 is applied, which is not shown in the drawing. When the composition in the vials 91 is of the right conditions with respect to specified residual content of dispersion medium, the headspace is brought in the final condition by aeration with either conditioned air or an inert gas such as nitrogen. This is done in the (Pre-)aeration & closure module where also the closure of the vials 91 is achieved by using for each vial 91*a* closing element 95. In the preferred embodiment the closure elements 95 such as rubber stoppers are transported in conjunction with the vials. In an alternative embodiment the closure elements are brought into the (Pre-) aeration & closure chamber 53 through another lock or feed-through. The Outfeed module 54 may contain final composition inspection or measurement and may even contain devices to mark vials 91 for unique identification. In order to maintain the conditions in each module, there are locks that connect the modules. The locks are designed for cleaning and sterilization. The transport of vials 91 in each module is achieved through endless belts in each module and robotic grippers and arms to pick and place the vials. In another embodiment one endless belt is applied throughout the whole system of connected modules.

Figure 2:
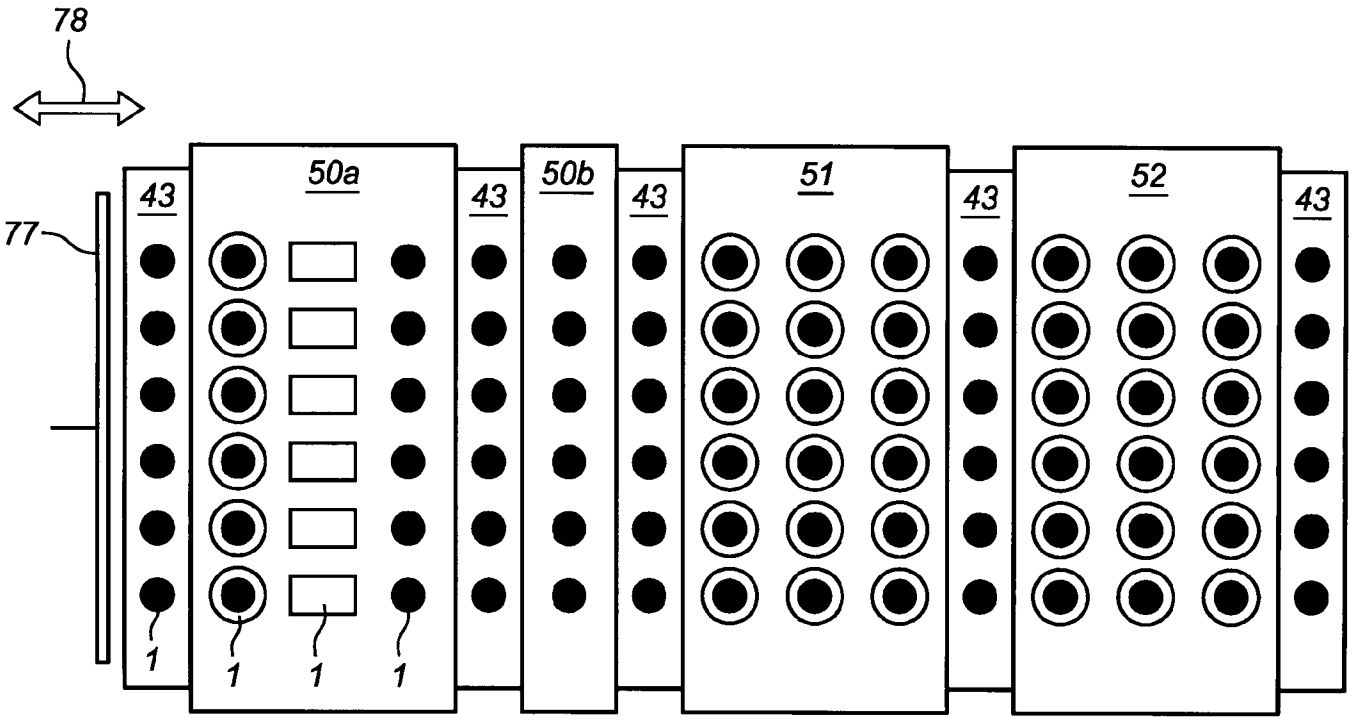
FIG. 2 shows a schematic top view of the system as shown in FIG. 1.

An alternative system embodiment is illustrated in FIG. 2. In this particular example 6 vials 1 with dispersion are transported and the process is executed in a simultaneous way. The infeed is executed by a pusher system 77, which pushes 6 vials 1 per stroke onto a transport device (not shown). In this embodiment the freezing module (50*a* and 50*b* is divided into two separate units: primary freezing 50*a* and secondary freezing 50*b*.

In the primary freezing unit 50*a* the contents of the vials 1 are cooled and solidified (i.e. ice formation) while rotating. This rotation first takes place with respect to a vertical axis, gradually this axis is rotated until the rotation of the vial is with respect to an axis in the horizontal plane. Once the ice crystals have formed the vials are placed in an upright position again for further transportation to the next unit. This is further illustrated in detail in FIGS. 5 and 6. During secondary freezing 50*b* the substance in the vial is further cooled in a controlled manner to achieve a proper constitution of the other ingredients of the dispersion. Via a lock system 43 the vials are transported to and through the sublimation module 51. Once the ice crystals have been sublimed the vials are transported to the next drying unit 52 for further desorption of the absorbed or embedded solvent material, which in most cases is water. Since the purpose of FIG. 2 is to illustrate the concept of processing multiple vials 1 with dispersion in a parallel manner, only the units which are relevant to the drying process are indicated here.

Figure 3:
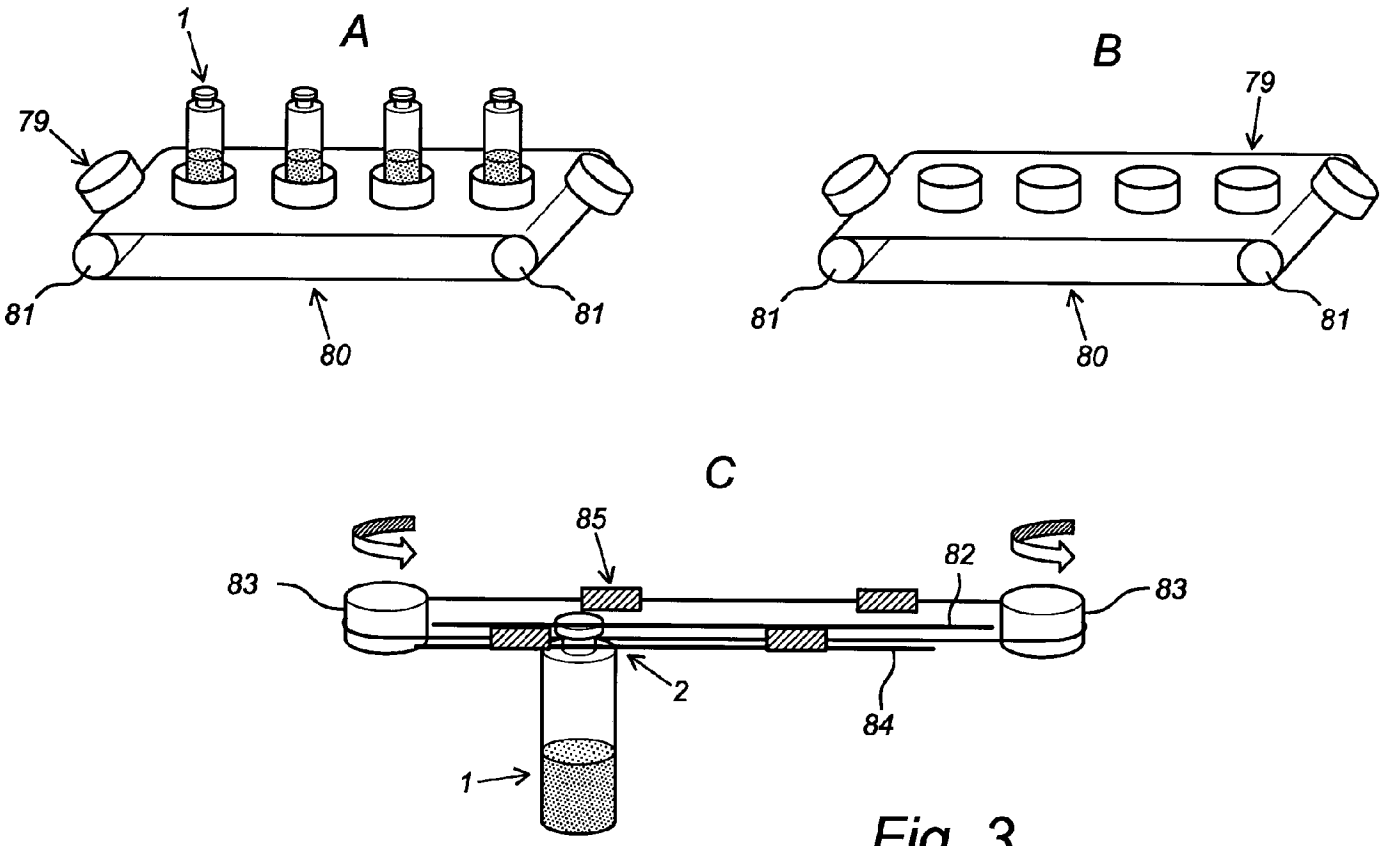

In FIG. 3 different embodiments of transport means are illustrated. In FIG. 3A an endless belt 80 is driven by pulleys 81 which in turn are actuated by electromotor (not shown).

This endless belt carries elements 79 that can hold vials 1. The carrier elements may be connected by electronic means to supply energy to the vials and dispersion during sublimation and desorption. An alternative embodiment, which is illustrated in FIG. 3B contains an endless belt 80 which is an open structure such as a wired mesh in order to facilitate the flow of air through it. This embodiment may be applied in the Freezing Module 50. The embodiment as illustrated in FIG. 3C transports the vials 1 by supporting the neck 2 of the vials 1. A separate wire 82 contains elements 85 to push the vials in a forward direction. This wire 82 is moving through a mechanism with pulleys 83 which in turn are actuated by electromotor (not shown).

Figure 5:
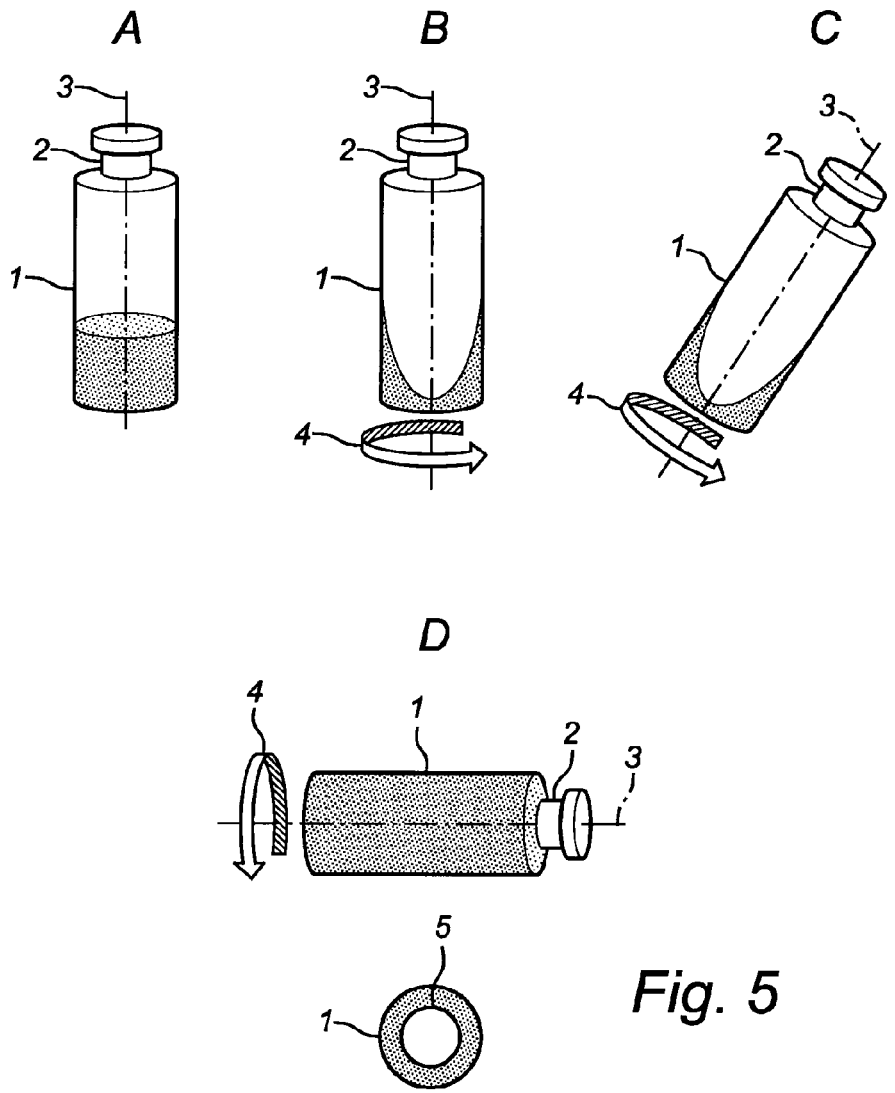

FIG. 4 illustrates an exemplary freezing cycle. The horizontal axis indicates the time, while the vertical axis is related to the dispersion temperature in the vial. For pure water the freezing point would be zero degrees Centigrade. For solutions the freezing or solidification point would be below this temperature. In absence of sufficient crystallization seeds (which often is the case in pharmaceutical environments with low numbers of stray particles) further sub-cooling occurs: the composition remains liquid below the physical freezing temperature. At a certain temperature the onset of crystallization occurs. A second sub-cooling an crystallization occurs when excipients first sub-cool and then crystallize. In some cases it may be necessary to perform an annealing step to restructure the crystals of the excipients. The graph illustrates the need for an adequate measurement and control system for adequate freezing procedures. FIG. 5 illustrates the process details of the solidification (primary freezing) process. The vial 1 rotates with respect to axis 3 in a direction as indicated by arrow 4. The liquid dispersion inside the vial 1*a* orients itself in a parabolic manner as is determined by physical force relationships, as is illustrated in 5B. While the rotation continues, the rotational axis 3 is rotated until a horizontal orientation is achieved, 5C and 5D. In this position the dispersion 1*a* is frozen with a layer with a uniform thickness, also called shell-freezing. The rotational speed which is needed for a uniform thickness of the layer is substantial lower in the horizontal orientation as compared to the vertical orientation of the rotational axis. By starting the rotation in the vertical orientation the spilling of fluid through the neck 2 of the vial is less likely to occur.

In FIG. 6 two embodiments for the freezing process with the flow of cold gas 7 are illustrated. In 6A the flow of gas 7 is in a radial direction, in 6B this occurs in an axial direction. The flow of cold gas 7 is supplied by the system 6. Through an optical system 9 which detects electromagnetic radiation in the infrared or far-infrared range 8, the condition of the freezing shell is measured. This measurement feeds a control system to adaptively control the temperature of the cold gas 7, as is further illustrated in FIG. 7. FIG. 7 illustrates a control loop for regulating the freezing process. The optical signals provide information about the physical state of the dispersion in the vial. The signals are digitized and processed with chemometric or spectroscopic methods. Depending of the result the system settings may need to be corrected. If correction is not needed the acquisition loop restarts. If a correction is needed the appropriate correction is applied and the acquisition loop restarts.

FIG. 8 illustrates a schematic of the Ranque-Hilsch vortex tube 10. Pressurized gas 15 is inserted into the tube 11 and a rotation element (not shown) causes the gas to move in a helical manner (to the right side, in this schematic drawing). The tube 17 is restricted by an adjustable cone 12. A small quantity of the gas is reflected and pushed into the left direction, while the remainder of the gas is ejected 13. The reflected portion of the gas continues to move in a helical fashion and is directed into the left portion 16 of the vortex tube 10. Due to the centrifugal force the gas in the outer vortex is of a higher pressure then the reflected gas in the inner vortex. Therefore a temperature difference between the two gas flows occurs. This leads to a cold fraction of gas 14 that can be used for cooling purposes.

FIG. 9 illustrates another embodiment of the gas cooling system 20. Pressurized gas 18 is flowing into a heat exchanging system 21 which contains a cooling medium 19 such as liquid Nitrogen (−195 degrees Centigrade) or solid carbon dioxide (−79 degrees Centigrade). The cold gas 22 is output to the subsequent thermal control system as described in FIG. 10.

FIG. 10 illustrates an embodiment to adjust the temperature of the initially cooled gas in order to achieve the conditions necessary for the process. The cold gas 28 is measured by a thermal sensor 23 such as a thermocouple or an optical device. This gas is flowing through a tube 27. At the exit the gas 29 is measured by a thermal sensor 24, such as a thermocouple or an optical device. The signals of the two thermal devices 23 and 24 are compared in a signal processing unit 25 and depending of the required gas temperature a signal is supplied to an electrical heating system 28 which also consists of electrical heating foils 26 surrounding the tube 27.

FIG. 11 illustrates three embodiments for holding the vials 1 while rotating during freezing. In 11A the vial is placed upon an assembly 30 that applies a vacuum combined with a deformable or elastic material to prevent leakage of air. In 11B a gripping system is shown. The grippers 31 are surrounding the neck 2 of the vial and are kept in place by a spring 32. 11C illustrates the third embodiment where a cone 33 made of elastic material is pressed into the neck 2 of the vial. Due to the frictional forces by selecting the appropriate material such as rubber the vial will be held firmly.

FIG. 12 illustrates an embodiment for freezing the contents of vials in a continuous manner. The vial 1 with dispersion is transported by a conveyor belt 38 and placed on an assembly 30 to apply a vacuum to hold the vial 1. While the assembly starts rotating the axis of rotation 3 is rotated by the second rotation device 31. While the two rotations continue the cold gas supply system freezes the contents of the vial 1. The rotation assembly 30 pushes and releases the vial 1 onto a transportation system 34. In this embodiment this transportation system consists of an endless belt 37 with spurs to push the vials forward. The belt 37 is driven by pulleys 36, which in turn are actuated by electromotor (not shown). Alternative embodiments for this transportation system are illustrated in FIG. 14.

The Freezing process is illustrated in FIG. 13. In this embodiment the process is split into primary freezing, i.e. solidifying of the solvent and secondary freezing for further cooling and crystallization and solidifying of the excipients and active ingredients. The primary freezing module 40 contains the system 39 which is illustrated in FIG. 12. The cold gas supply 6 absorbs the sufficient amount of heat to initiate the freezing. In order to facilitate a different thermal regime in the two modules, a lock 43 is placed between the two modules. During secondary freezing in unit 41 another cold gas supply unit 42 is used to generate the optimal conditions. A transportation means 33 assures a continuous transport of the vials 1 while a certain rotation is maintained to guarantee a uniform thermal distribution.

Figure 14:
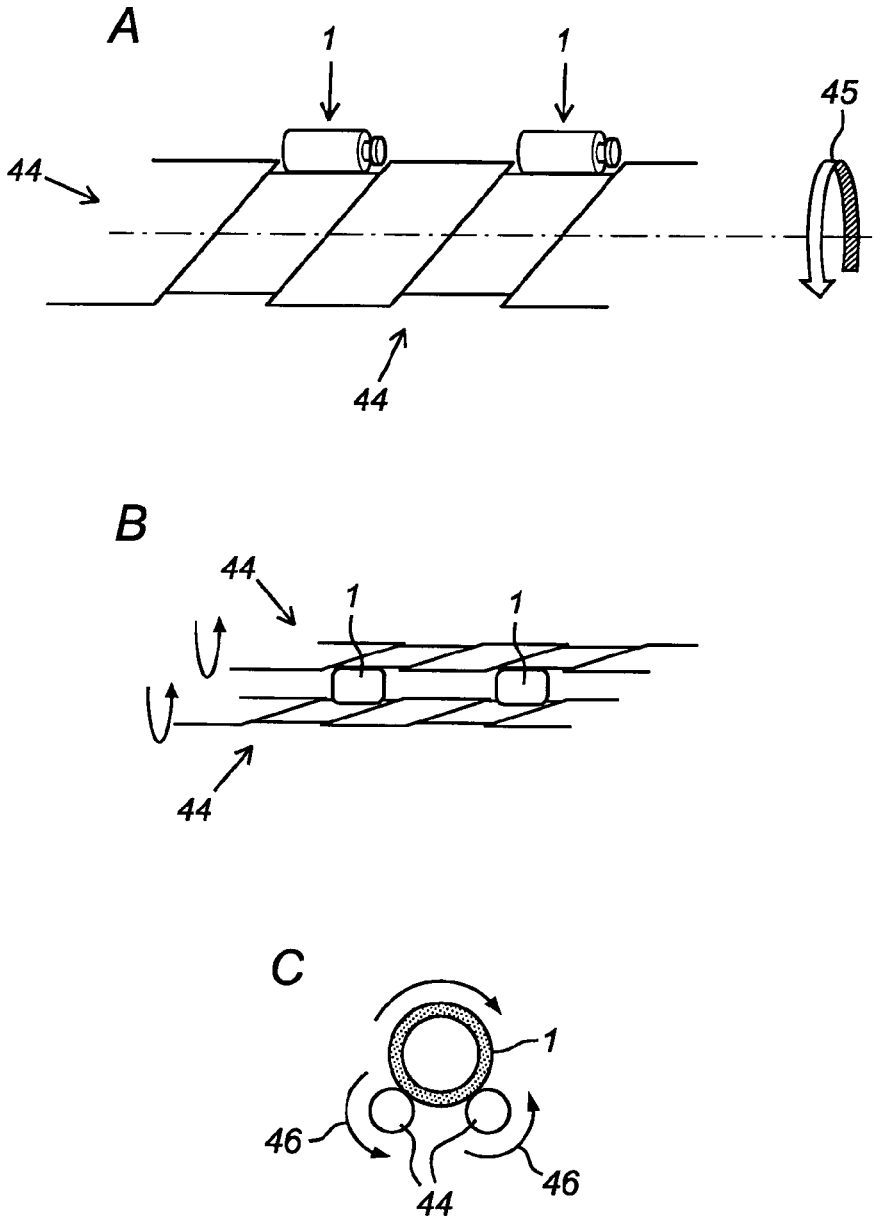

FIG. 14 illustrates two embodiments of a transport mechanism for vials, which continuously rotate with respect to a horizontal axis. In FIG. 14A a rotating cylindrical structure 44 with a helical pattern transports the vials 1 while the vials 1 rotate due to frictional forces. The vials 1 are guided by side-guides (not shown). In FIG. 14B two rotating cylindrical structures 44 carry the vials 1. The two structures 44 rotate in a in such a direction that due to frictional forces the vials 1 rotate. In FIG. 14C this is further illustrated.

In FIG. 15 the operation phases of a vacuum lock for vials is schematically illustrated. In FIG. 15A a moving bar 59 pushes the vial 1 onto the moving platform of the vacuum lock 55. The vacuum lock consists of a rotating chamber, divided into four segments, which form four chambers separated by vacuum-tight walls. The moving bar 59 lifts in order to give way to the next vial 1, transported by the conveyor belt 61, while the next chamber-segment in the lock is being exposed. FIG. 15B illustrates the next step in the rotary movement of the platform with the vial 1. The chamber segment is connected to a vacuum-line 56 and a vacuum pump 57 to bring the segment to the conditions needed for the next module. In FIG. 15C the vial 1 is pushed by the rotating chamber segment to a movable guide 60, which guides the vial 1 onto the conveyor belt 62. FIG. 15D illustrates the preparation phase for the chamber-segment to receive one of the next vials. The chamber-segment is aerated through a tube, where the flow of gas is regulated by valve 58.

FIG. 16 illustrates another embodiment of a vacuum-lock system. The lock consists of an outer cylinder 67 with two openings 66 and an inner cylinder 64, with one opening 68. The inner cylinder 64 rotates with respect to a vertical axis 69. Elastic seals or gaskets 65 ascertain a vacuum tight enclosure when the opening 68 of the inner cylinder 64 does not coincide with one of the two openings 66 of the outer cylinder 67 as is indicated by position B. Three positions are indicated by A, B and C. In position A a vial (not shown) can be moved into the inner cylinder 64. When the inner cylinder 64 has moved to the position indicated by B, the inner cylinder is brought to a vacuum by a vacuum pump (not shown). In position C the vial (not shown) is taken out of the vacuum-lock system by a robotic gripper system (not shown) and the vacuum-lock is ready to receive the next vial.

Another embodiment for the transport of vials between modules with different (vacuum) conditions is illustrated in FIG. 17. The two modules (not shown) are separated by a wall 72, which has an opening through which a cassette system can be moved. The cassette system consists of tree segments. The vial 1 is held in a pocket by the bottom segment 71. The top segment 70 then closes the pocket in a vacuum-tight fashion. The two segments 70 and 71 are held together by the third segment 73. FIG. 17B illustrates the passing of the vial 1 through the wall 72 where the leak of vacuum is kept to a minimum, which can be compensated by vacuum pumps (not shown). FIG. 17C illustrates in a schematic fashion the release of the vial 1 which is transported further by the conveyor belt 62, after which the cassette is ready to accept the next vial. FIG. 18 shows a schematic view of another embodiment of the segmented cassette system. When the top 70 and the bottom 71 are closed the cylindrical shape may pass conveniently through a circular hole in the divider wall between process modules (not shown).

Figure 19:
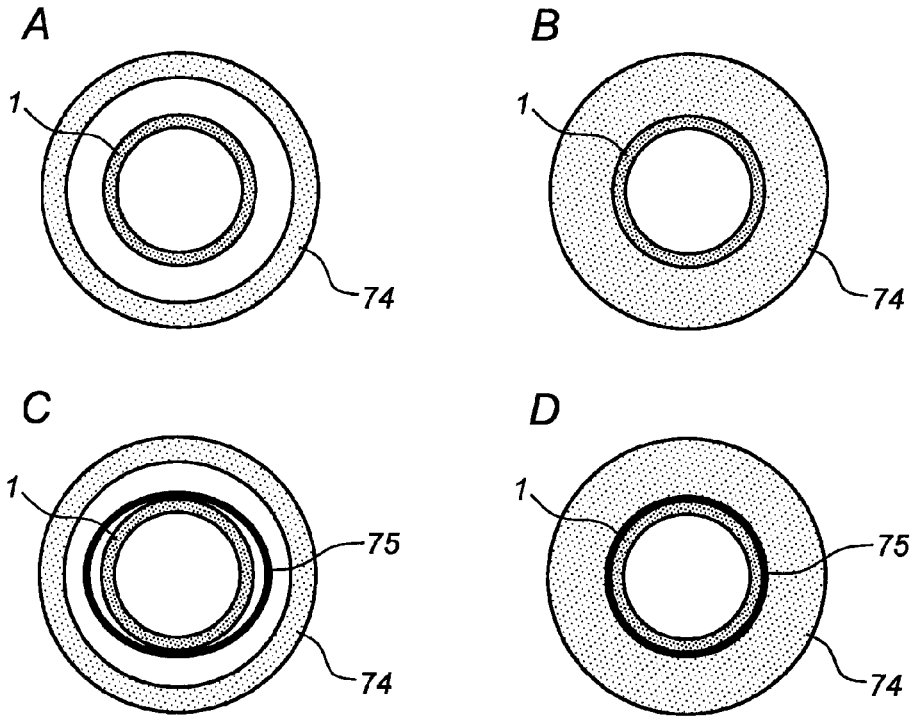
Figure 21:
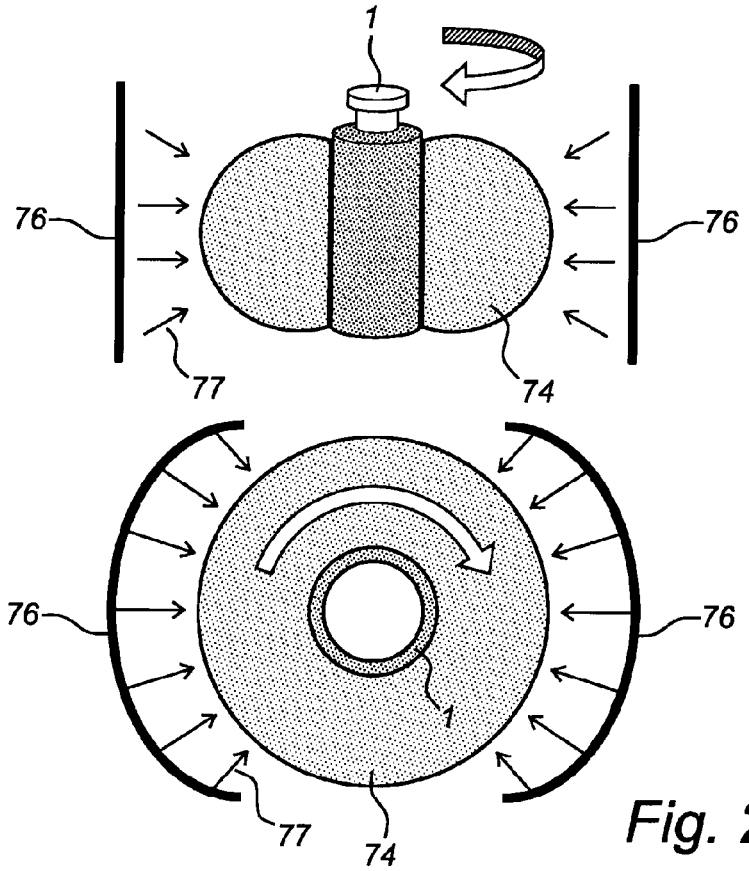

In FIG. 19 two embodiments for transferring thermal energy to the vial with frozen dispersion 1 are illustrated in plan view. An elastic device 74 may be inflated to provide a close contact between the vial 1 and the device 74. In FIGS. 19A and 19B this is done by filling the elastic device 74 with a liquid. The temperature of this liquid may be controlled to assure a certain energy supply to the vial 1 which is uniform. In FIG. 21 an embodiment to raise the temperature of this liquid is schematically illustrated. In 19C and 19D a foil 75 is inserted between the inflatable device 74 and de vial 1. The foil 75 may contain electrically conducting leads and by applying an electrical current the temperature of the foil can be controlled and heat transfer to the vial 1 and its contents can be achieved. In an alternative embodiment, the foil may be thermally conducting and by a tight connection to a base plate (not shown) thermal energy can be conveyed from the base plate via the foil 75 to the vial 1. This is further illustrated in FIG. 20. FIG. 20 shows a cross-sectional side view of the inflatable device 74, the foil 75 and the vial 1. Two alternative embodiments are illustrated. In FIG. 20B the foil contains a lead pattern 75*a* for electrical current and the heat is transferred to the vial 1. In FIG. 20A the electrical coil 77 symbolizes the inductive coupling between the baste plate 76 and an electrical power source. This inductive coupling may generate the current for the electrically conducting lead pattern on the foil as indicated in FIG. 20B. In another embodiment, the electrical coil symbolizes the source of a varying magnetic field. Induction currents in the base plate (Eddy Currents) then heat the base plate 76, which in turn heats the conducting foil 75.

FIG. 21 shows a cross-sectional side view and a plan view of the vial 1 in a close fit with the inflatable device 74. The inflatable device 74 contains a liquid which contains dipole molecules and which remains liquid even at the temperatures commonly used to freeze the contents of dispersions for freeze drying (−40 degrees Celsius). In this embodiment a varying electrical field as commonly is used in magnetron equipment is emitted by two antenna's 76. The electrical field is schematically indicated by the arrows 77. As can be concluded by a person skilled in the art, one antenna 76 may be adequate since the vial 1 and the inflatable device 74 rotate. The varying electrical field causes the dipole molecules to vibrate and rotate and this is transformed into heat which causes the temperature of the contents of the inflatable device 74 to rise. The elevated temperature drives the flow of thermal energy to the vial 1 and its contents.

FIG. 22 illustrates two alternative embodiments to hold the vial 1 is a close fit. In both embodiments the vial 1 is held by mechanical means. Two half-circular shaped elements 84 are put around the vial 1. In FIG. 22C this is done through a gripper mechanism 87. In FIG. 22D this is done through the use of the elements 84 mount on a cassette 79 and rotate on pivot points 86. When the vial 1 is pushed into the cassette 79 the elements 84 align with the vial 1. The elements 84 may be heated by similar methods as has been illustrated and described with FIG. 20.

In FIG. 23 the vials 1 are conveyed with an endless belt 80 with rubber closures 82 which will placed into the vials 1 after the composition in the vials 1 is dried. The endless belt 80 may also consist of a linked chain of pockets or cassettes as a person skilled in the art will understand. An embodiment of placing the rubber closures 82 onto the vials 1 is illustrated in FIG. 24.

In FIG. 24 an embodiment to execute the placing of the rubber closures 82 onto the vials 1. The endless conveyor belt 80 transports the vial 1 and the closure 82. A robotic gripper system 81 picks the rubber closure 82 and performs the necessary actions to put the closure 82 onto the vial 1 as is schematically illustrated in FIG. 24A. In FIG. 24A the 3-dimensional coordinates are indicated by 79. The movement of the vial 1, the closure 83 and the belt 80 is in the −z direction as is also indicated by arrow 83. The movement of the robotic gripper 81 is as follows: a: the robotic gripper 81 moves in the −x direction until the closure 82 is held; b: the robotic gripper 81 moves in the y direction until the closure 82 is above the vial 1; c: the robotic gripper 81 moves in the −x direction until the closure 82 is above the opening of the vial 1; d: the robotic gripper 81 moves in the −y direction until the closure 82 is moved into the opening of the vial 1; e: without the closure 82 the robotic gripper 81 moves in the y-direction; f: while a until e take place the robotic gripper 81 moves in the −z direction with the same speed as the vial 1; g: the robotic gripper 81 moves in the x direction, g is smaller than c; h: the robotic gripper 81 repeats the movement in the −y direction with the gripper arms in such a position that the top of the closure 82 is in contact in order to push the closure 82 in its final position, h is larger than d; i: the robotic gripper 81 moves in the y direction; j: the robotic gripper 81 moves in the x direction; l: while i until k take place the robotic gripper 81 returns to the initial position. In this schematic drawing the mechanical manipulating devices in conjunction with the robotic gripper 81 are not shown. The end-result of the placement of the closure 82 is shown in FIG. 24C.

In FIG. 25 an optical inspection system is schematically illustrated. An optical source 84, e.g. a laser system, emits an electromagnetic beam 86 onto the surface of the dispersion in the vial 1. In FIG. 25A this beam 86 is directed to the inner surface of the dispersion in the vial 1. Because the dispersion originally is frozen in a shell, the inner part of the vial 1 is empty as is illustrated in plan view in FIG. 25C and therefore the reflected beam 87 may leave the vial 1 undisturbed. The reflected beam is absorbed by the detector 85. In FIG. 25B the electromagnetic beam 86 is directed to the outside of the vial 1. The differences between FIG. 25A and FIG. 25B can be described as follows: In FIG. 25A the electromagnetic beam 86 probes the inner surface of the dispersion. During the drying process this is the first region which is deprived of ice crystals. Besides the measurement of the content of moisture, the method is also applicable for measuring temperature and as such it is possible to derive the condition of the deeper regions of the dispersion. In FIG. 25B the outer surface of the dispersion is measured, assuming that the presence of the material of the vial is not disturbing. This is valid for the electromagnetic radiation in the Near InfraRed and in the Terahertz region. The outer surface of the dispersion will be frozen during the sublimation phase until all ice crystals have been sublimed. The absence of ice crystals at any time will result in a clear change of the appearance of the reflected electromagnetic beam. Also in this case the temperature of the outer surface can be assessed and an inference can be made on the remainder of the dispersion.

In FIG. 26 a schematic illustration is presented of a continuous measurement system which supports the control of the sublimation or the desorption process. A beam of electromagnetic radiation 86 which may be in the near-, mid- or far-infrared, depending on the specific situation, is directed into the vial 1 by a laser 84 in such a manner that the shell of dispersion is reflecting this beam to the detector 85. The detector transmits the detection signal to a computer system 90. The computer system 90 transforms the signal into a digital form and the computer program decomposes the acquired spectra into relevant dispersion or composition information. This dispersion information may consist of the amount of residual solvent, but also the chemical composition and the spatial structure (such as polymorphism) can be assessed. It is important that the movement of the vials is synchronized with the detection equipment. Therefore the system also consists of an optical sensing device 88, 89 to accurately detect the location of the vial which is used to synchronize the measurement. When the vial is located at the desired position, the optical sensing device 88, 89 sends a signal to the computer system 90, which in turn sends a signal to the laser 84 and detector 85 to execute the measurement. The detector 85 sends the acquired signals to the computer 90, which processes the signals to information about the dispersion or composition in the vial. This information is stored on the computer 90 and is also used to adapt the relevant process settings of the sublimation or desorption process.

In FIG. 27 a schematic description of the control of the sublimation or desorption process is given in a flow chart. The first loop is to determine the right position of the vial that will be measured. Once the vial is in the right position, the measurement is executed and the signals are processed. Depending on the acquired outcome of the quality attribute that is measured, the process may stop and the vial may be transported to the next module. If the quality level has not been reached yet, the process settings may be adapted. In this embodiment, which is presented as an example, the energy supply or the transport speed can be adapted. As a person skilled in the art would understand other process conditions not indicated in this schematic presentation may be adapted, such as the value of the vacuum pressure.

It will be apparent that the invention is not limited to the exemplary embodiments shown and described here, but that within the scope of the appended claims numerous variants are possible which will be self-evident to the skilled person in this field.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provide below as one of skill in the art will recognize that inventive concepts illustrated in various examples can be combined together in order to address a specific application.

Other systems, methods, features and advantages of the disclosed teachings will be or will become apparent to one with skill in the art upon examination of the following figures and detailed description. It is intended that all such additional systems, methods, features and advantages be included within the scope of and be protected by the accompanying claims.

The invention claimed is:

1. A method for freeze-drying injectable compositions, comprising:

A) storing a quantity of a dispersion of an injectable composition in an aqueous dispersion medium in at least one ready-to-use vial, B) rotating the vial at least for a period of time to form a dispersion layer at an inner surface of a circumferential wall of the vial, C) during rotating of the vial according to step B), cooling the vial to form a frozen shell of ice crystals at the inner surface of the circumferential wall of the vial by applying cold gas to the vial, and D) drying the cooled composition to sublime at least a portion of the ice crystals formed in the dispersion layer by homogeneously heating the circumferential wall of the vial, wherein step C) comprises:

(i) optically measuring a condition of the frozen shell using an optical system arranged outside the rotating vial, the optical system being configured to detect electromagnetic radiation in an infrared or far-infrared range, and (ii) adaptively controlling a temperature of the cold gas using the measured condition of the frozen shell.

2. The method according to claim 1, wherein the method comprises a step E) comprising a secondary heating step, wherein the vial is additionally heated in order to drive ionically bound water from the composition.

3. The method according to claim 1, wherein during step D) a moisture content of the composition is detected by way of:

directing a beam of electromagnetic radiation which may be in a near-, mid- or far-infrared, into the vial;

detecting a reflected beam coming from the frozen shell using a detector;

transmitting a detection signal to a computer system; and transforming the signal, by the computer system, into a digital form decomposing the acquired spectra into dispersion information consisting of an amount of residual solvent.

4. The method according to claim 3, wherein the method further comprises controlling the sublimation process by controlling of an energy supply towards the vial and depending on the amount of residual solvent.

5. The method according to claim 1, wherein during step D) the method further comprises applying an inflatable heating jacket surrounding the circumferential wall of the vial for homogeneously heating the circumferential wall of the vial, the heating jacket being configured to engage in an inflated state of the heating jacket under a bias with the outer surface of the circumferential wall of the vial for providing a close contact between the vial and the heating jacket.

6. A freeze-dried composition obtained by the method according to claim 1.

7. A system for freeze-drying injectable compositions comprising:

(i) at least one rotating element for rotating a ready-to-use vial for an injectable composition in an aqueous dispersion medium to form a dispersion layer at an inner surface of a circumferential wall of the vial, (ii) at least one cooling module for cooling said vial during rotation to form a frozen shell of ice crystals at the inner wall of the vial, (iii) at least one sublimation module provided with at least one heating source to sublime at least a portion of the ice crystals formed in the dispersion by homogeneously heating the circumferential wall of the vial, (iv) an optical system arranged outside the rotating vial, the optical system being configured to detect electromagnetic radiation in an infrared or far-infrared range, so as to measure a condition of the frozen shell, and (v) a control system arranged to adaptively control a temperature of the cold gas using the measured condition of the frozen shell.

8. The system according to claim 7, wherein the system comprises:

a light source for directing a beam of electromagnetic radiation which may be in a near-, mid- or far-infrared, into the vial;

an optical sensor for detecting a reflected beam coming from the frozen shell; and, a control unit connected to said optical sensor for transforming the signal into a digital form decomposing the acquired spectra into dispersion information consisting of an amount of residual solvent.

9. The system according to claim 8, wherein the control unit is configured to monitor a moisture of the composition.

10. The system according to claim 8, wherein the control unit is arranged for controlling the sublimation process by adapting an energy supply towards the vial depending on the measurement by the optical sensor.

11. The system according to claim 7, wherein the heating source comprises an inflatable heating jacket configured for surrounding the circumferential wall of the vial for homogeneously heating the circumferential wall of the vial, the heating jacket being configured to engage in an inflatable state, under bias with the outer surface of the circumferential wall of the vial for providing a close contact between the vial and the heating jacket.

* * * * *